US008765336B2

(12) United States Patent
Zhu et al.

(10) Patent No.: US 8,765,336 B2
(45) Date of Patent: Jul. 1, 2014

(54) ELECTROPHOTOGRAPHIC PHOTORECEPTOR AND MANUFACTURING METHOD THEREFOR

(75) Inventors: Fengqiang Zhu, Matsumoto (JP); Yoichi Nakamura, Matsumoto (JP); Shinjiro Suzuki, Matsumoto (JP)

(73) Assignee: Fuji Electric Co., Ltd., Kawasaki-Shi (JP)

( * ) Notice: Subject to any disclaimer, the term of this patent is extended or adjusted under 35 U.S.C. 154(b) by 64 days.

(21) Appl. No.: 13/582,706

(22) PCT Filed: Mar. 1, 2010

(86) PCT No.: PCT/JP2010/053263

§ 371 (c)(1),
(2), (4) Date: Oct. 5, 2012

(87) PCT Pub. No.: WO2011/108064

PCT Pub. Date: Sep. 9, 2011

(65) Prior Publication Data

US 2013/0022904 A1 Jan. 24, 2013

(51) Int. Cl.

| | |
|---|---|
| ***G03G 5/04*** | (2006.01) |
| ***G03G 5/05*** | (2006.01) |
| ***G03G 5/047*** | (2006.01) |

(52) U.S. Cl.

CPC ..... *G03G 5/0517* (2013.01); *G03G 5/047* (2013.01)

USPC ..... 430/58.05; 430/59.1; 430/127

(58) Field of Classification Search

CPC ..... G03G 5/0517; G03G 5/047

USPC ..... 430/58.05, 59.1, 127

See application file for complete search history.

(56) References Cited

U.S. PATENT DOCUMENTS

| | | | |
|---|---|---|---|
| 3,342,880 | A | 9/1967 | Reinhardt |
| 4,952,470 | A | 8/1990 | Tamaki et al. |

(Continued)

FOREIGN PATENT DOCUMENTS

| | | |
|---|---|---|
| EP | 0989162 A1 | 3/2000 |
| JP | S48-10055 | 2/1973 |

(Continued)

*Primary Examiner* — Peter Vajda
(74) *Attorney, Agent, or Firm* — Rabin & Berdo, P.C.

(57) ABSTRACT

An electrophotographic photoreceptor and a manufacturing method therefore are disclosed. The electrophotographic photoreceptor includes a conductive base; and a photosensitive layer provided on the conductive base and containing a diadamantyl diester compound represented by General Formula (I) below:

(I)

where, $R_1$, $R_2$ and $R_3$ each independently represent a hydrogen atom, halogen atom, optionally substituted $C_{1-6}$ alkyl group, optionally substituted $C_{1-6}$ alkoxyl group, $C_{6-20}$ aryl group or heterocyclic group, X and Z represent single bonds or optionally substituted $C_{1-6}$ alkylene groups, and Y represents an OCO group or COO group. The electrophotographic photoreceptor has sufficient wear resistance and satisfactory properties as a photoreceptor, while being little affected by harmful gasses and environmental temperature and humidity.

18 Claims, 3 Drawing Sheets

(56) References Cited

U.S. PATENT DOCUMENTS

| | | | |
|---|---|---|---|
| 5,665,500 | A | 9/1997 | Suzuki |
| 6,030,733 | A | 2/2000 | Kami et al. |
| 6,210,848 | B1 | 4/2001 | Nagai et al. |
| 6,313,327 | B1 | 11/2001 | Seo et al. |
| 2006/0068310 | A1 | 3/2006 | Nozomi et al. |
| 2006/0134541 | A1 | 6/2006 | Fujii et al. |
| 2010/0028791 | A1 | 2/2010 | Takaki et al. |

FOREIGN PATENT DOCUMENTS

| | | | |
|---|---|---|---|
| JP | S57-122444 | A | 7/1982 |
| JP | 560-100537 | A | 6/1985 |
| JP | S63-18355 | A | 1/1988 |
| JP | 04-174859 | A | 6/1992 |
| JP | H6-75394 | A | 3/1994 |
| JP | H6-118678 | A | 4/1994 |
| JP | 06-161125 | A | 6/1994 |
| JP | H7-168381 | A | 7/1995 |
| JP | H08-272126 | A | 10/1996 |
| JP | H9-265177 | | 7/1997 |
| JP | H11-288113 | A | 10/1999 |
| JP | 2001-13708 | A | 1/2001 |
| JP | 2001-39928 | A | 2/2001 |
| JP | 2001-072645 | A | 3/2001 |
| JP | 2002-268250 | A | 9/2002 |
| JP | 2002-287388 | A | 10/2002 |
| JP | 2003-306469 | A | 10/2003 |
| JP | 2004-199051 | A | 7/2004 |
| JP | 2004-206109 | A | 7/2004 |
| JP | 2004-226637 | A | 8/2004 |
| JP | 2007-279446 | A | 10/2007 |
| WO | WO-99/50356 | A1 | 10/1999 |

ELECTROPHOTOGRAPHIC PHOTORECEPTOR AND MANUFACTURING METHOD THEREFOR

BACKGROUND OF THE INVENTION

1. Field of the Invention

The present invention relates to an electrophotographic photoreceptor (hereunder also called simply a "photoreceptor") for use in electrophotographic printers, copiers, fax machines and the like, and to a manufacturing method therefore, and relates particularly to an electrophotographic photoreceptor having excellent printing durability and gas resistance due to additive improvements, and to a manufacturing method therefore.

2. Background of the Related Art

In general, an electrophotographic photoreceptor must have the function of holding a surface charge in the dark, the function of generating charge in response to received light, and similarly the function of transporting charge in response to received light. Such photoreceptors include monolayer photoreceptors that are provided with a monolayer photosensitive layer having all these functions, and stacked photoreceptors that are provided with a photosensitive layer comprising a stack of functionally discrete layers: primarily, a layer that contributes to the function of charge generation and a layer that contributes to the functions of holding a surface charge in the dark and transporting charge during photoreception.

The Carlson process for example may be applied to image formation by electrophotography using these electrophotographic photoreceptors. In this process, images are formed by charging the photoreceptor in a dark place, forming an electrostatic image of characters, pictures or the like from an original document on the surface of the charged photoreceptor, developing the formed electrostatic image with toner, and transferring the developed toner image to a support such as paper. After toner image transfer, residual toner and charge are removed from the photoreceptor, which can then be reused.

Selenium, selenium alloys, zinc oxide, and cadmium sulfide and other inorganic photoconductive materials dispersed in resin binders and poly-N-vinyl carbazole, 9,10-anthracene diol polyester, pyrazoline, hydrazone, stilbene, butadiene, benzidine, phthalocyanine, and bisazo compounds and other organic photoconductive materials dispersed in resin binders and vacuum deposits and sublimates of these may be used as materials of such electrophotographic photoreceptors.

In recent years, with increased printing loads due to office networking and with rapid development of quick printing machines using electrophotography, electrophotographic printers are being required to have even greater durability and sensitivity as well as more rapid responsiveness. There is also strong demand for reductions in the effects of ozone, Nox and other gases generated within these devices, and for reduced fluctuation in image properties and the like due to fluctuations in the usage environment (room temperature, humidity).

At present, however, conventional photoreceptors do not always fulfill all the necessary requirements, and problems such as the following have arisen.

For example, the following problems arise with respect to wear resistance. In recent years, high-speed printing has become the norm due to the introduction of tandem imaging systems and the like not only in black-and-white printers and copiers, but also in machines that perform color printing. In addition to high resolution, precise image positioning has become an important requirement specification in recent years for color printers in particular. As more pages are printed, the surface of the photoreceptor becomes worn by friction with the paper and the various rollers, blades and the like, and when the degree of wear is large it becomes difficult to print images with a high degree of resolution and highly precise image positioning. There have already been a variety of studies aimed at improving wear resistance, but these have not been satisfactory.

Ozone is well known among the gasses produced within the devices. Ozone is produced by roller chargers and charging mechanisms using corona discharge, and it is thought that when the photoreceptor is exposed to ozone that remains or accumulates inside the device, the organic substances making up the photoreceptor become oxidized and their intrinsic structures are broken down, greatly degrading the properties of the photoreceptor. Nox is also produced when nitrogen in the air is oxidized by ozone, and it is thought that this Nox also degrades the organic substances making up the photoreceptor.

Such property degradation caused by gasses is thought to involve not only damage to the outermost layer of the photoreceptor, but also adverse effects that occur when gasses penetrate the inside of the photosensitive layer. It is believed that the outermost layer of the photoreceptor is itself whittled away to a greater or lesser extent by friction with the various other members discussed above, but when harmful gas penetrates the inside of the photosensitive layer, the structures of the organic substances within the photosensitive layer may be damaged, so controlling such penetration of harmful gasses is an issue. In tandem-type color electrophotographic devices using multiple photoreceptors in particular, one obstacle to production of satisfactory images is thought to be the variations in hue that occur when there are differences in the degree of effect of gasses according to the positioning of the drums inside the device and the like. Thus, property degradation due to gasses is a particularly important problem in tandem-type color electrophotographic devices.

In Patent Document 1 and Patent Document 2, hindered phenol compounds, phosphorus compounds, sulfur compounds, amine compounds, hindered amine compounds and other antioxidants are used for improving gas resistance. Patent Document 3 proposes a technique using a carbonyl compound, while Patent Document 4 proposes a technique using a benzoate compound or salicylate ester compound. Techniques for improving gas resistance are also proposed using a specific polycarbonate resin together within biphenyl and other additives in Patent Document 5, using a combination of a specific amine compound and a polyarylate resin in Patent Document 6, and using a combination of a polyarylate resin and a compound with a specific light absorbency in Patent Document 7. With these techniques, however, either the resulting photoreceptor is not sufficiently gas resistant, or even if the gas resistance properties are satisfactory wear resistance is not improved, and satisfactory results have also not been obtained for other properties (image memory, potential stability during printing endurance and the like).

Patent Document 8 shows that the effects on the photoreceptor of gas occurring around the charging mechanism can be controlled by keeping the oxygen gas permeability coefficient of the surface layer below a certain level when combined with a charge transport layer having a particular degree of charge mobility. Meanwhile, Patent Document 9 shows that wear resistance and gas resistance can be improved by keeping steam penetration of the photosensitive layer below a specific value, but with this technique the desired effects can only be obtained using a specific polymer charge transport material, and because of limitations on the structure and mobility of the charge transport material, this is not compatible with a the demands of various electrical properties.

According to Patent Document 10, a monolayer electrophotographic photoreceptor with superior gas resistance can be obtained using a specific diester compound with a melting point of 40° C. or less in the photosensitive layer. However, when a substance with a low melting point is added to this layer and the photoreceptor containing the substance is in long-term contact with a cartridge or parts of a device body, satisfactory results may not be obtained because the compound seeps into the contacting parts in a phenomenon called bleeding, causing image defects.

Regarding property fluctuation of the photoreceptor according to usage environment, one example is image property degradation in low-temperature, low-humidity environments. That is, in general the apparent sensitivity properties and the like of the photoreceptor are reduced in low-temperature, low-humidity environments, resulting in obvious deterioration in image quality (loss of image concentration, tone loss in halftone images). Image memory resulting from reduction sensitivity properties may become conspicuous. This occurs because during printing, an image recorded as a latent image in the first drum rotation is also affected by potential fluctuations during the second and subsequent drum rotations, and when printing halftone images in particular, the image deteriorates because printing occurs in unwanted areas. Negative memory, in which the concentration of the printed image is reversed, is often conspicuous in low-temperature, low-humidity environments.

Another example is image property degradation in high-temperature, high-humidity environments. That is, in general the transfer speed of charge in the photosensitive layer is higher in high-temperature, high-humidity environments than at normal temperature and humidity, and problems of excessive increase in printing concentration and tiny black spots (fogging) in solid white images are observed as a result. An excessive increase in printing concentration causes increased toner consumption, and tone gradations are also lost because the diameter of each dot is increased. In terms of image memory, in the reverse of the situation in low-temperature, low-humidity environments, there is often a conspicuous problem of positive memory, in which the concentration of the printed image is reproduced as is.

Such property degradation due to temperature and humidity conditions is commonly caused by the absorption or release of moisture from the charge generating material or the resin binder in the surface layer of the photosensitive layer. Various means have already been studied to deal with this, such as by adding specific compounds to the charge-generating layer as in Patent Document 11 and Patent Document 12, or by using a specific polycarbonate polymer charge transport material in the surface layer as in Patent Document 13, but as yet no satisfactory material has been discovered having the necessary properties for controlling the effects of temperature and humidity on the photoreceptor and the like.

The technique disclosed in Patent Document 14 can solve the problem of property degradation caused by temperature and humidity as discussed above, but is not necessarily satisfactory in terms of wear resistance. Moreover, although Patent Document 15 discloses a diallyl adamantane dicarboxylic acid useful as a raw material of a resin that can be used as an optical material or electrical material, compounds having adamantane structures have not been sufficiently studied as additives for photoreceptors. In addition, Patent Document 16 discloses a photoresist composition containing a compound having an adamantane structure.

Patent Document 17 discloses a carboxylic acid derivative having an adamantane structure, while Patent Document 18 discloses a novel adamantane carboxylic acid ester compound, and Patent Documents 19 and 20 disclose methods of synthesizing diadamantyl diester compounds, but the use of these compounds as additives for photoreceptors is not adequately addressed in any of these documents.

Patent Document referred to in the foregoing include:

Patent Document 1: Japanese Patent Application Publication No. S57-122444;

Patent Document 2: Japanese Patent Application Publication No. S63-18355;

Patent Document 3: Japanese Patent Application Publication No. 2002-268250;

Patent Document 4: Japanese Patent Application Publication No. 2002-287388;

Patent Document 5: Japanese Patent Application Publication No. H6-75394;

Patent Document 6: Japanese Patent Application Publication No. 2004-199051;

Patent Document 7: Japanese Patent Application Publication No. 2004-206109;

Patent Document 8: Japanese Patent Application Publication No. H08-272126;

Patent Document 9: Japanese Patent Application Publication No. H11-288113;

Patent Document 10: Japanese Patent Application Publication No. 2004-226637;

Patent Document 11: Japanese Patent Application Publication No. H6-118678;

Patent Document 12: Japanese Patent Application Publication No. H7-168381;

Patent Document 13: Japanese Patent Application Publication No. 2001-13708;

Patent Document 14: Japanese Patent Application Publication No. 2007-279446;

Patent Document 15: Japanese Patent Application Publication No. S60-100537;

Patent Document 16: Japanese Patent Application Publication No. H9-265177;

Patent Document 17: Japanese Patent Application Publication No. 2001-39928;

Patent Document 18: Japanese Patent Application Publication No. 2003-306469;

Patent Document 19: U.S. Pat. No. 3,342,880; and

Patent Document 20: Japanese Patent Application Publication No. S48-10055.

As discussed above, various techniques have been proposed in the past for improving photoreceptors. However, while the techniques described in these patent documents are satisfactory in terms of wear resistance and the properties of the photoreceptors, they are not able to sufficiently control the adverse effects of harmful gasses and environmental temperature and humidity on the photoreceptor, and further improvements are needed.

It is therefore an object of the present invention to provide an electrophotographic photoreceptor having sufficient wear resistance and satisfactory characteristics as a photoreceptor, while being little affected by harmful gasses and environmental temperature and humidity.

SUMMARY OF THE INVENTION

As a result of exhaustive research focused on the structures of resin binders used in the various layers of photoreceptors, the inventors discovered that voids produced at the molecular level when a resin binder forms a film are a cause of the various problems discussed above, and discovered that these problems could be solved by including a diadamantyl diester compound having a specific structure in the film, and exploiting the ability of the diadamantyl diester compound to fill these voids.

At present, the principal resins used in the surface layers of photoreceptors are polycarbonate and polyallylate resins and the like. When forming the photosensitive layer, various functional materials are dissolved in a solvent, and this is then applied to a base by dip coating, spray coating or the like to form a coated film. The film is formed with the functional materials enveloped in the resin binder, but voids that are too large to be ignored may form in the film at the molecular level. If these voids are large, they may detract from the wear resistance of the photoreceptor, or the electrical characteristics may be adversely affected by the intrusion of gas and steam and other low-molecular weight gasses.

Thus, it was thought that by filling the voids formed in the resin binder with molecules of a suitable size, it would be possible to form a stronger film, improve wear resistance, and control intrusion of harmful gas and steam and other low-molecular-weight gasses, resulting in a photoreceptor that would not be liable to electrical and image property degradation caused by environmental variation. The inventors achieved the present invention as a result of this research.

That is, the electrophotographic photoreceptor of the present invention is an electrophotographic photoreceptor comprising a conductive base; and at least a photosensitive layer provided on the conductive base and containing a diadamantyl diester compound represented by General Formula (I) below:

(I)

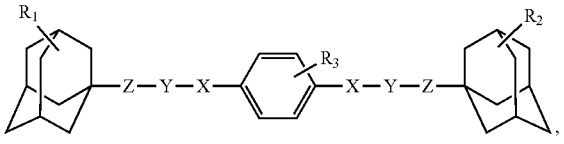

where, $R_1$, $R_2$ and $R_3$ each independently represent a hydrogen atom, halogen atom, optionally substituted $C_{1-6}$ alkyl group, optionally substituted $C_{1-6}$ alkoxyl group, $C_{6-20}$ aryl group or heterocyclic group, X and Z represent single bonds or optionally substituted $C_{1-6}$ alkylene groups, Y represents an OCO group or COO group, and in cases of substitution the substituent is a halogen atom, amino group, imino group, nitro group, nitroso group or nitrile group.

Moreover, the electrophotographic photoreceptor of the present invention is an electrophotographic photoreceptor comprising a conductive base; and at least an under coat layer provided on the conductive base and containing a diadamantyl diester compound represented by General Formula (I) above.

Moreover, the electrophotographic photoreceptor of the present invention is an electrophotographic photoreceptor comprising a conductive base; and at least a charge generating layer provided on a conductive base and containing a diadamantyl diester compound represented by General Formula (I) above.

Moreover, the electrophotographic photoreceptor of the present invention is an electrophotographic photoreceptor comprising a conductive base; and at least a charge transport layer provided on the conductive base and containing a diadamantyl diester compound represented by General Formula (I) above.

Moreover, the electrophotographic photoreceptor of the present invention is an electrophotographic photoreceptor comprising a conductive base; and at least a surface protective layer provided on the conductive base and containing a diadamantyl diester compound represented by General Formula (I) above.

In the present invention, the photosensitive layer may be a positively-charged monolayer-type layer. The photosensitive layer may be a positively-charged stacked-type layer. Moreover, the diadamantyl diester compound preferably has a structure represented by Formula (I-1) below. The electrophotographic photoreceptor may further comprise a resin binder contained in the layer containing the diadamantyl diester compound, and said layer preferably may contain up to 30 mass parts of the diadamantyl diester compound per 100 mass parts of the resin binder.

(I-1)

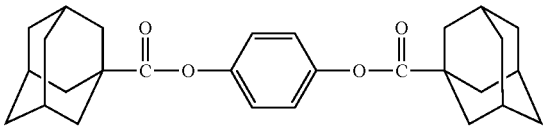

The method of manufacturing the electrophotographic photoreceptor of the present invention is an electrophotographic photoreceptor manufacturing method comprising the steps of providing a coating liquid containing a diadamantyl diester compound represented by General Formula (I) above; and applying the coating liquid to a conductive base to form a layer.

By including the aforementioned diadamantyl diester compound in the photosensitive layer, surface protective layer or other surface layer of the photoreceptor in the present invention, it is possible to improve wear resistance, control intrusion of harmful gasses and steam into the photosensitive layer and achieve a photoreceptor that undergoes little fluctuation in electrical and image properties due to environmental variation, regardless of the properties of the charge transport material and the like. In a stacked photoreceptor, moreover, it is possible to control intrusion of harmful gasses, steam and the like into the film and achieve a photoreceptor that undergoes little fluctuation in electrical and image properties due to environmental changes by using this diadamantyl diester compound in the charge generating layer or under coat layer. Thus, the present invention achieves an electrophotographic photoreceptor of electrical properties of which are more stable and are not affected by the types of organic substances used or by fluctuation in the temperature or humidity of the usage environment, and which is not liable to memory and other image defects. The diadamantyl diester compound of the present invention was not known in the past.

BRIEF DESCRIPTION OF THE DRAWING

FIG. 1(*b*) is a cross-sectional view showing one example of a positively charged monolayer electrophotographic photoreceptor of the present invention; and FIG. 1(*c*) is a cross-sectional view showing one example of a positively charged, functionally separate stacked electrophotographic photoreceptor of the present invention;

DETAILED DESCRIPTION OF THE INVENTION

Figure 1A:
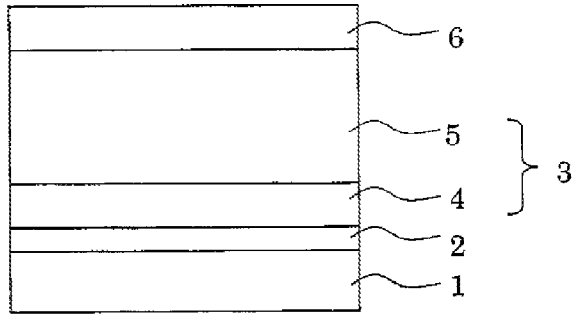
FIG. 1(*a*) is a cross-sectional view showing one example of a negatively charged, functionally separate stacked electrophotographic photoreceptor of the present invention.

Specific embodiments of the electrophotographic photoreceptor of the present invention are explained in detail below using the drawing. The present invention is not in any way limited by the following explanations.

Figure 1B:
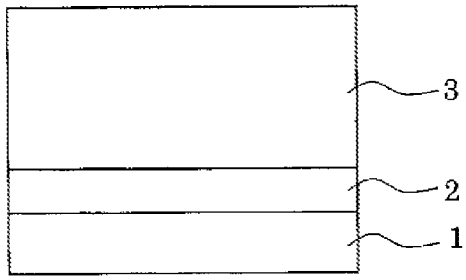
Figure 1C:
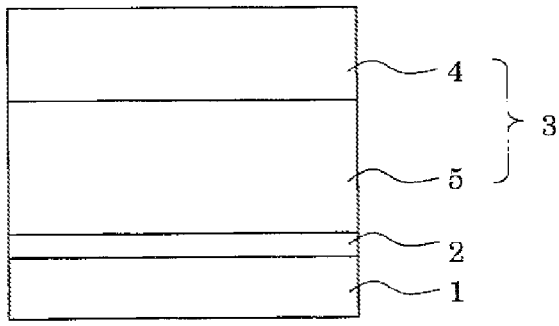

As discussed above, electrophotographic photoreceptors can be broadly categorized into negatively charged stacked photoreceptors and positively charged stacked photoreceptors, which are functionally separate stacked photoreceptors, and monolayer photoreceptors, which are usually positively charged. FIG. 1 shows cross-sectional views of electrophotographic photoreceptors of one example of the present invention, with FIG. 1(*a*) showing one example of a negatively-charged, functionally separate stacked electrophotographic photoreceptor, FIG. 1 (*b*) one example of a positively charged monolayer electrophotographic photoreceptor, and FIG. 1 (*c*) one example of a positively charged, functionally separate stacked electrophotographic photoreceptor. In a negatively charged stacked photoreceptor, as shown in the figure, an under coat layer 2 and a photosensitive layer 3 comprising a charge generating layer 4 with a charge generating functional and a and charge transport layer 5 with a charge transport function are stacked in that order on a conductive base 1. In a positively charged monolayer photoreceptor, an under coat layer 2 and a single photosensitive layer 3 having both a charge generating function and a charge transport function are stacked in that order on a conductive base 1. In a positively charged stacked photoreceptor, an under coat layer 2 and a photosensitive layer 3 comprising a charge transport layer 5 with a charge transport function and a charge generating layer 4 with a charge generating function are stacked in that order on a conductive base 1. The under coat layer 2 can be provided as necessary on any type of photoreceptor, and a further surface protective layer 6 may also be provided on the photosensitive layer 3. In the present invention, the concept of a "photosensitive layer" includes both stacked photosensitive layers comprising a stacked charge generating layer and charge transport layer, and monolayer photosensitive layers.

In the present invention, it is vital that a diadamantyl diester compound represented by General Formula (I) above be included in at least one of the layers making up the photoreceptor. That is, in the case of a photoreceptor with a configuration comprising at least a photosensitive layer on a conductive base, and particularly one comprising a positively charged photosensitive layer, the desired effects of the present invention can be obtained by including this compound in the photosensitive layer. In a photoreceptor with a configuration comprising at least an under coat layer on a conductive base, moreover, the desired effects of the present invention can be obtained by including this compound in the under coat layer. Also, in a photoreceptor with a configuration comprising at least a charge generating layer on a conductive base, the desired effects of the present invention can be obtained by including this compound in the charge generating layer. In addition, in a photoreceptor with a configuration comprising at least a charge transport layer on a conductive base, the desired effects of the present invention can be obtained by including this compound in the charge transport layer. Additionally, in an electrophotographic photoreceptor having at least a surface protective layer on a conductive base, the desired effects of the present invention can be obtained by including this compound in the surface protective layer.

In any of the types of photoreceptors described above, the amount of the diadamantyl diester compound that is used in the photosensitive layer is preferably 30 mass parts or less or more preferably 1 to 30 mass parts or still more preferably 3 to 25 mass parts per 100 mass parts of the binder resin contained in the layer. An amount of the diadamantyl diester compound in excess of 30 mass parts is undesirable because precipitation occurs. The same applies to the amount of the diadamantyl diester compound when it is included in a layer apart from the photosensitive layer.

Structural examples of diadamantyl diester compounds represented by General Formula (I) of the present invention are shown below. However, the compound used in the present invention is not limited to these.

(I-1)

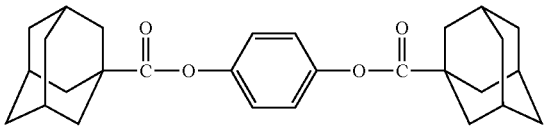

(I-2)

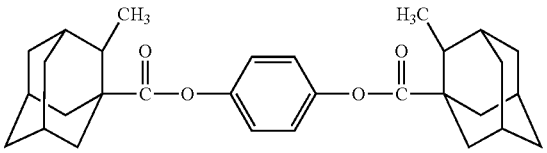

(I-3)

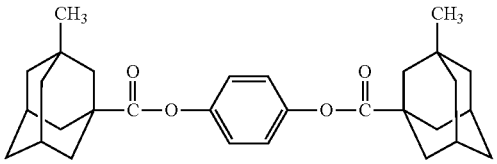

(I-4)

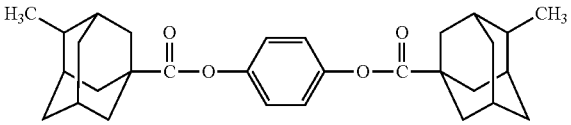

(I-5)

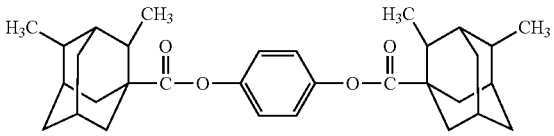

(I-6)

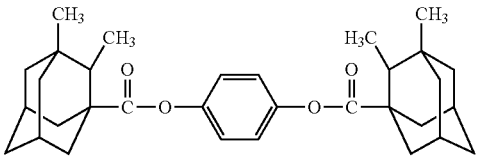

-continued
(I-7)
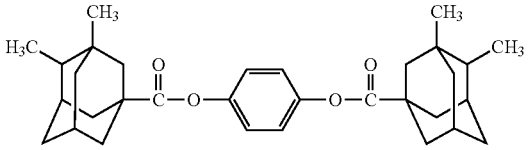
(I-8)
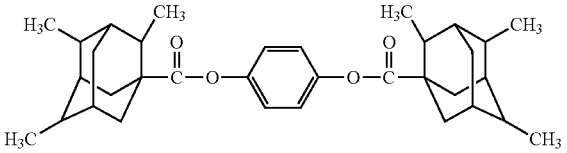
(I-9)
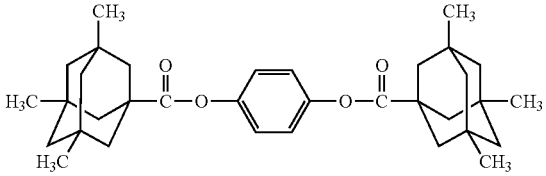
(I-10)
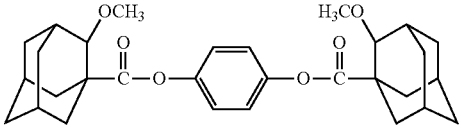
(I-11)
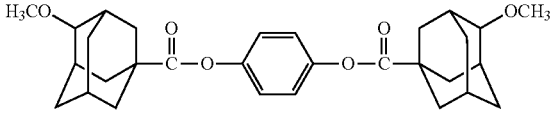
(I-12)
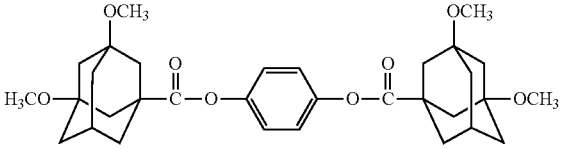
(I-13)
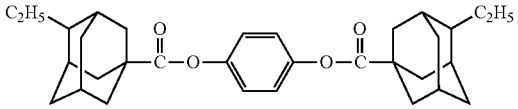
(I-14)
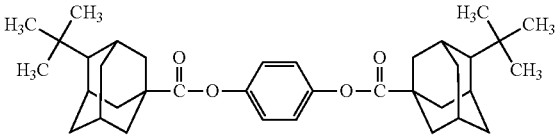
(I-15)
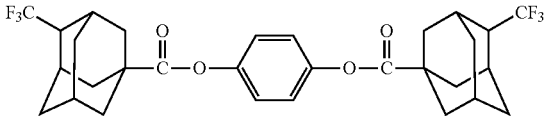
(I-16)
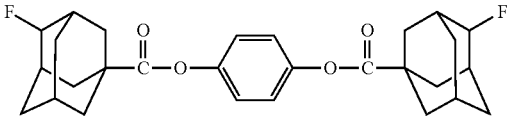
(I-17)
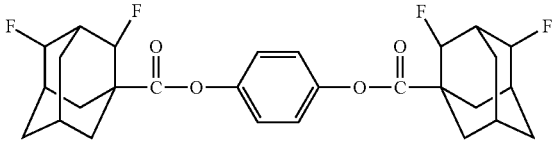
(I-18)
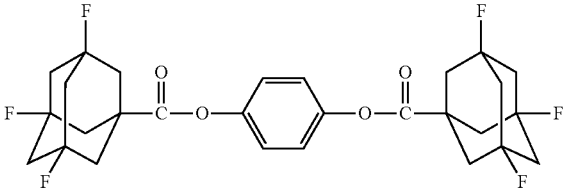
(I-19)
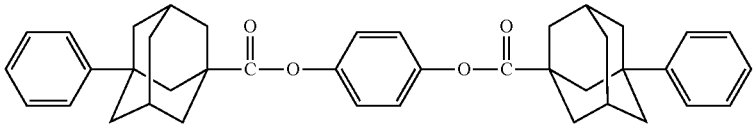
(I-20)
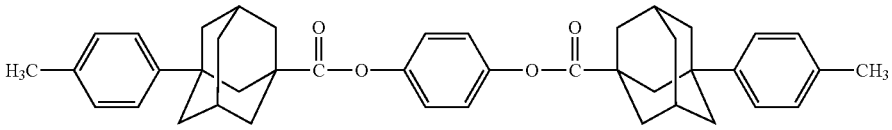

TABLE 1

| Compound | Groups in General Formula (I)*1 | | | | | |
|---|---|---|---|---|---|---|
| | X | Y | Z | $R^1$ | $R^2$ | $R^3$ |
| No. I-21 | $CH_2$ | O<br>‖<br>—C—O— | Single bond | H | H | H |
| No. I-22 | $CH_2$ | O<br>‖<br>—C—O— | Single bond | 2-Me | 2-Me | 2-Me |
| No. I-23 | $CH_2$ | O<br>‖<br>—C—O— | Single bond | 3-Me | 3-Me | 2-Me |
| No. I-24 | $CH_2$ | O<br>‖<br>—C—O— | Single bond | 4-Me | 4-Me | 2-Me |
| No. I-25 | $CH_2$ | O<br>‖<br>—C—O— | Single bond | 4-OMe | 4-OMe | 2-Me |
| No. I-26 | $CH_2$ | O<br>‖<br>—C—O— | Single bond | 4-Et | 4-Et | 2-Me |
| No. I-27 | $CH_2$ | O<br>‖<br>—C—O— | Single bond | 4-tBu | 4-tBu | 2-Me |
| No. I-28 | $CH_2$ | O<br>‖<br>—C—O— | Single bond | $4CF_3$ | $4CF_3$ | 2-Me |
| No. I-29 | Single bond | O<br>‖<br>—C—O— | $CH_2$ | H | H | H |
| No. I-30 | Single bond | O<br>‖<br>—C—O— | $CH_2$ | 2-Me | 2-Me | 2-Me |
| No. I-31 | Single bond | O<br>‖<br>—C—O— | $CH_2$ | 3-Me | 3-Me | 2-Me |
| No. I-32 | Single bond | O<br>‖<br>—C—O— | $CH_2$ | 4-Me | 4-Me | 2-Me |
| No. I-33 | Single bond | O<br>‖<br>—C—O— | $CH_2$ | 4-OMe | 4-OMe | 2-Me |
| No. I-34 | Single bond | O<br>‖<br>—C—O— | $CH_2$ | 4-Et | 4-Et | 2-Me |
| No. I-35 | Single bond | O<br>‖<br>—C—O— | $CH_2$ | 4-tBu | 4-tBu | 2-Me |
| No. I-36 | Single bond | O<br>‖<br>—C—O— | $CH_2$ | $4CF_3$ | $4CF_3$ | 2-Me |
| No. I-37 | $CH_2$ | O<br>‖<br>—C—O— | $CH_2$ | H | H | H |
| No. I-38 | $CH_2$ | O<br>‖<br>—C—O— | $CH_2$ | 2-Me | 2-Me | 2-Me |
| No. I-39 | $CH_2$ | O<br>‖<br>—C—O— | $CH_2$ | 3-Me | 3-Me | 2-Me |

TABLE 1-continued

| Compound | Groups in General Formula (I)*1 | | | | | |
|---|---|---|---|---|---|---|
| | X | Y | Z | $R^1$ | $R^2$ | $R^3$ |
| No. I-40 | $CH_2$ | O<br>‖<br>—C—O— | $CH_2$ | 4-Me | 4-Me | 2-Me |

TABLE 2

| Compound | Groups in General Formula (I)*1 | | | | | |
|---|---|---|---|---|---|---|
| | X | Y | Z | $R^1$ | $R^2$ | $R^3$ |
| No. I-41 | $CH_2$ | O<br>‖<br>—C—O— | $CH_2$ | 4-OMe | 4-OMe | 2-Me |
| No. I-42 | $CH_2$ | O<br>‖<br>—C—O— | $CH_2$ | 4-Et | 4-Et | 2-Me |
| No. I-43 | $CH_2$ | O<br>‖<br>—C—O— | $CH_2$ | 4-tBu | 4-tBu | 2-Me |
| No. I-44 | $CH_2$ | O<br>‖<br>—C—O— | $CH_2$ | $4CF_3$ | $4CF_3$ | 2-Me |
| No. I-45 | Single bond | O<br>‖<br>—O—C— | Single bond | H | H | H |
| No. I-46 | Single bond | O<br>‖<br>—O—C— | Single bond | 2-Me | 2-Me | 2-Me |
| No. I-47 | Single bond | O<br>‖<br>—O—C— | Single bond | 3-Me | 3-Me | 2-Me |
| No. I-48 | Single bond | O<br>‖<br>—O—C— | Single bond | 4-Me | 4-Me | 2-Me |
| No. I-49 | Single bond | O<br>‖<br>—O—C— | Single bond | 4-OMe | 4-OMe | 2-Me |
| No. I-50 | Single bond | O<br>‖<br>—O—C— | Single bond | 4-Et | 4-Et | 2-Me |
| No. I-51 | Single bond | O<br>‖<br>—O—C— | Single bond | 4-tBu | 4-tBu | 2-Me |
| No. I-52 | Single bond | O<br>‖<br>—O—C— | Single bond | $4CF_3$ | $4CF_3$ | 2-Me |
| No. I-53 | $CH_2$ | O<br>‖<br>—O—C— | Single bond | H | H | H |
| No. I-54 | $CH_2$ | O<br>‖<br>—O—C— | Single bond | 2-Me | 2-Me | 2-Me |
| No. I-55 | $CH_2$ | O<br>‖<br>—O—C— | Single bond | 3-Me | 3-Me | 2-Me |
| No. I-56 | $CH_2$ | O<br>‖<br>—O—C— | Single bond | 4-Me | 4-Me | 2-Me |

TABLE 2-continued

| Compound | Groups in General Formula (I)*1 | | | | | |
|---|---|---|---|---|---|---|
| | X | Y | Z | $R^1$ | $R^2$ | $R^3$ |
| No. I-57 | $CH_2$ | —O—C(=O)— | Single bond | 4-OMe | 4-OMe | 2-Me |
| No. I-58 | $CH_2$ | —O—C(=O)— | Single bond | 4-Et | 4-Et | 2-Me |
| No. I-59 | $CH_2$ | —O—C(=O)— | Single bond | 4-tBu | 4-tBu | 2-Me |
| No. I-60 | $CH_2$ | —O—C(=O)— | Single bond | $4CF_3$ | $4CF_3$ | 2-Me |

TABLE 3

| Compound | Groups in General Formula (I)*1 | | | | | |
|---|---|---|---|---|---|---|
| | X | Y | Z | $R^1$ | $R^2$ | $R^3$ |
| No. I-61 | Single bond | —O—C(=O)— | $CH_2$ | H | H | H |
| No. I-62 | Single bond | —O—C(=O)— | $CH_2$ | 2-Me | 2-Me | 2-Me |
| No. I-63 | Single bond | —O—C(=O)— | $CH_2$ | 3-Me | 3-Me | 2-Me |
| No. I-64 | Single bond | —O—C(=O)— | $CH_2$ | 4-Me | 4-Me | 2-Me |
| No. I-65 | Single bond | —O—C(=O)— | $CH_2$ | 4-OMe | 4-OMe | 2-Me |
| No. I-66 | Single bond | —O—C(=O)— | $CH_2$ | 4-Et | 4-Et | 2-Me |
| No. I-67 | Single bond | —O—C(=O)— | $CH_2$ | 4-tBu | 4-tBu | 2-Me |
| No. I-68 | Single bond | —O—C(=O)— | $CH_2$ | $4CF_3$ | $4CF_3$ | 2-Me |
| No. I-69 | $CH_2$ | —O—C(=O)— | $CH_2$ | H | H | H |
| No. I-70 | $CH_2$ | —O—C(=O)— | $CH_2$ | 2-Me | 2-Me | 2-Me |
| No. I-71 | $CH_2$ | —O—C(=O)— | $CH_2$ | 3-Me | 3-Me | 2-Me |
| No. I-72 | $CH_2$ | —O—C(=O)— | $CH_2$ | 4-Me | 4-Me | 2-Me |

TABLE 3-continued

| Compound | Groups in General Formula (I)*1 | | | | | |
|---|---|---|---|---|---|---|
| | X | Y | Z | $R^1$ | $R^2$ | $R^3$ |
| No. I-73 | $CH_2$ | —O—C(=O)— | $CH_2$ | 4-OMe | 4-OMe | 2-Me |
| No. I-74 | $CH_2$ | —O—C(=O)— | $CH_2$ | 4-Et | 4-Et | 2-Me |
| No. I-75 | $CH_2$ | —O—C(=O)— | $CH_2$ | 4-tBu | 4-tBu | 2-Me |
| No. I-76 | $CH_2$ | —O—C(=O)— | $CH_2$ | $4CF_3$ | $4CF_3$ | 2-Me |

*1 In General Formula (I), X, Y and Z are arranged symmetrically with respect to the phenyl group. Y in the table binds to X on the right side and to Z on the left side.

The conductive base 1 functions as one electrode of the photoreceptor while also being a support for the layers making up the photoreceptor, and may be in any form such as cylindrical, plate or film form, and a metal such as aluminum, stainless steel or nickel or a glass or resin material that has been given a surface conductive treatment can be used as the material thereof.

The under coat layer 2 is a layer consisting mainly of resin or an alumite or other metal oxide film, and is provided as necessary in order to control the injection of charge from the conductive base into the photosensitive layer, to cover up defects on the surface of the base, and to improve adhesiveness between the photosensitive layer and the substrate. Examples of resin materials that can be used in the under coat layer 2 include casein, polyvinyl alcohol, polyamide, melamine, cellulose and other insulating polymers, and polythiophene, polypyrrole, polyaniline and other conductive polymers. These resins can be used individually, or mixed together as appropriate. Metal oxides such as titanium dioxide and zinc oxide can also be included in these resins.

(Negatively Charged Stacked Photoreceptor)

In the negatively charged stacked photoreceptor, the charge generating layer 4 is formed by a method such as applying a coating liquid comprising particles of a charge generating material dispersed in a resin binder, and generates charge in response to received light. It is important that it have both a high charge generating efficiency and the ability to inject the generated charge into the charge transport layer 5, preferably with little field dependency and good injection even under low-field conditions. X-type metal-free phthalocyanine, τ-type metal-free phthalocyanine, α-type titanyl phthalocyanine, β-type titanyl phthalocyanine, Y-type titanyl phthalocyanine, γ-type titanyl phthalocyanine, amorphous titanyl phthalocyanine, ϵ-type copper phthalocyanine and other phthalocyanine compounds and various azo pigments, anthanthrone pigments, thiapyrilium pigments, perylene pigments, perinone pigments, squarilium pigments, quinacridone pigments and the like can be used individually or combined appropriately as charge generating materials, and a substance suited to the wavelength range of the exposure light source used in image formation can be selected by preference.

As long as the charge generating layer 4 has a charge generating function, its film thickness is determined by the absorption coefficient of the charge generating material, and is normally 1 μm or less or preferably 0.5 μm or less. The charge generating material forms the basis of the charge generating layer, which can also have a charge transport material and the like added thereto. Polymers and copolymers of polycarbonate resin, polyester resin, polyamide resin, polyurethane resin, vinyl chloride resin, vinyl acetate resin, phenoxy resin, polyvinyl acetal resin, polyvinyl butyral resin, polystyrene resin, polysulfone resin, diallyl phthalate resin and methacrylate ester resin and the like can be combined appropriately as resin binders.

The charge transport layer 5 is composed principally of a charge transport material and a resin binder. Various hydrazone compounds, styryl compounds, diamine compounds, butadiene compounds, indole compounds and the like can be used individually or combined appropriately as charge transport materials. Bisphenol A, bisphenol Z, bisphenol A-biphenyl copolymer, bisphenol Z-biphenyl copolymer and various other polycarbonate resins, and polyallylate resin, polyphenylene resin, polyester resin, polyvinyl acetal resin, polyvinyl butyral resin, polyvinyl alcohol resin, vinyl chloride resin, vinyl acetate resin, polyethylene resin, polypropylene resin, acrylic resin, polyurethane resin, epoxy resin, melamine resin, silicone resin, polyamide resin, polystyrene resin, polyacetal resin, polysulfone resin and methacrylate ester polymers and copolymers of these and the like can be used independently or suitable mixtures of these can be used as the resin binder. A mixture of resins of the same kind with different molecular weights can also be used. The amount of the charge transport material used in the charge transport layer 5 is 50 to 90 mass parts or preferably 3 to 30 mass parts per 100 mass parts of the resin binder. The content of the resin binder is preferably 10 to 90 mass % or more preferably 20 to 80 mass % of the solids in the charge transport layer 5.

The following are examples of the charge transport material used in the charge transport layer 5, but the present invention is not limited thereby.

II-1

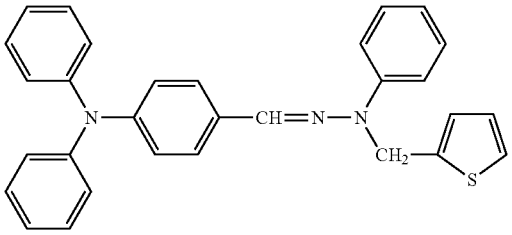

II-2

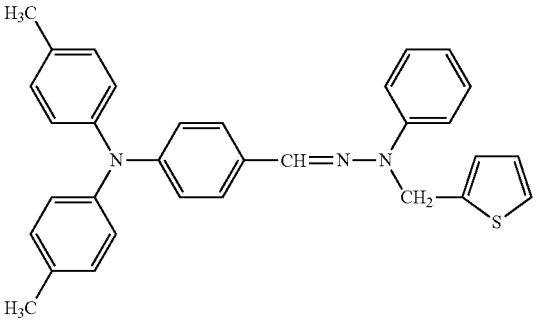

II-3

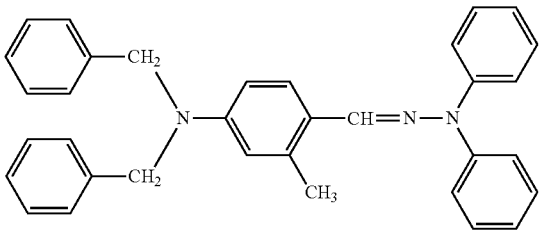

II-4

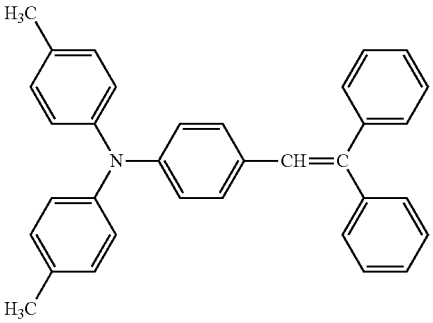

II-5

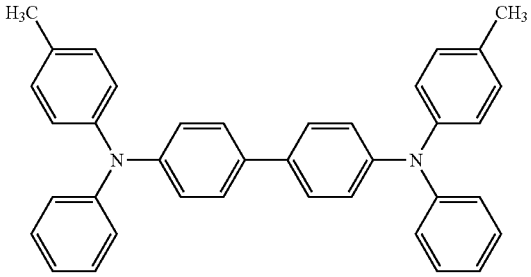

II-6

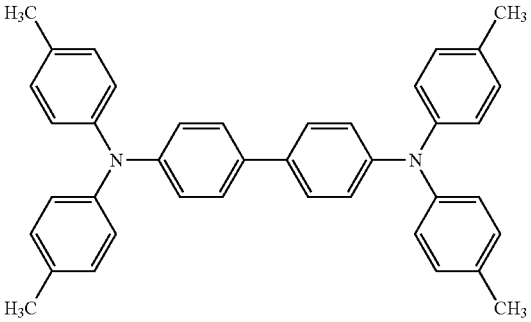

-continued
II-7
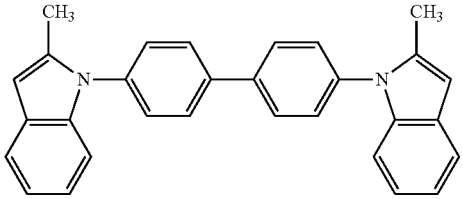
II-8
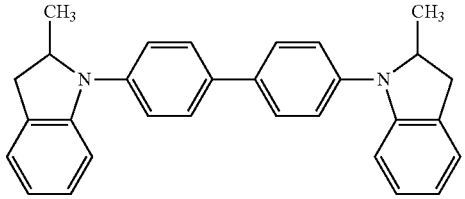
II-9
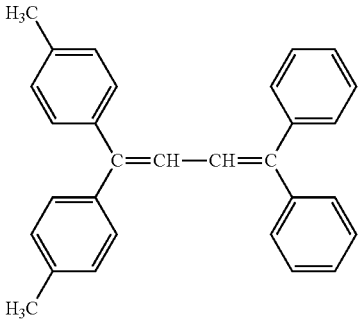
II-10
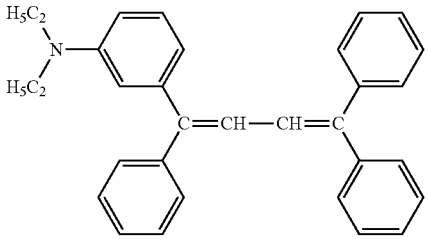
II-11
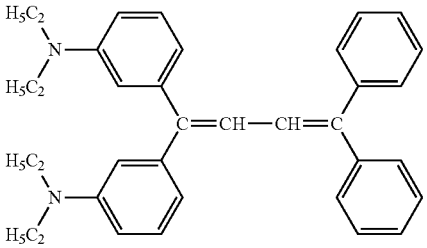
II-12
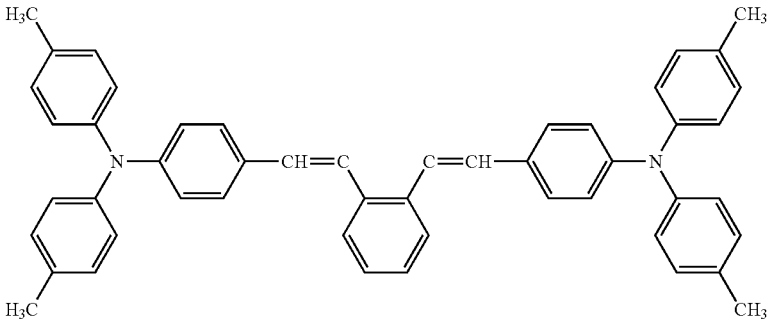
II-13
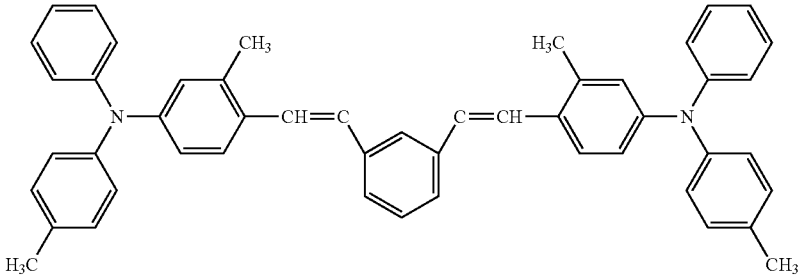

-continued

II-14

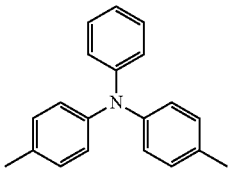

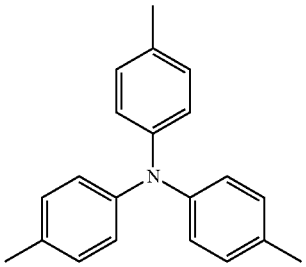

II-15

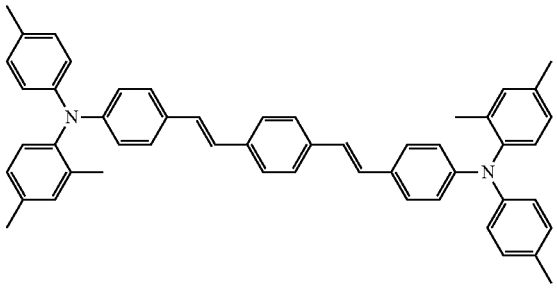

II-16

The film thickness of the charge transport layer 5 is in the range of preferably 3 to 50 μm or more preferably 15 to 40 μm in order to maintain an effective surface potential for practical use.

(Monolayer Photoreceptor)

In the case of a monolayer photoreceptor, the photosensitive layer 3 consists primarily of a charge generating material, a hole transport material, an electron transport material (acceptor compound) and a resin binder in the present invention. A phthalocyanine pigment, azo pigment, anthanthrone pigment, perylene pigment, perinone pigment, polycyclic quinone pigment, squarylium pigment, thiapyrilium pigment, quinacridone pigment or the like for example can be used as the charge generating material in this case. These charge generating materials may be used independently, or two or more may be used in combination. In the electrophotographic photoreceptor of the present invention, disazo pigments and trisazo pigments are particularly desirable as azo pigments, N,N'-bis(3,5-dimethylphenyl)-3,4:9,10-perylene-bis(carboxylmide) as a perylene pigment, and metal-free phthalocyanine, copper phthalocyanine and titanyl phthalocyanine as phthalocyanine pigments. Moreover, notable improvements in sensitivity, durability and image quality are obtained by using X-type metal-free phthalocyanine, τ-type metal-free phthalocyanine, ϵ-type copper phthalocyanine, α-type titanyl phthalocyanine, β-type titanyl phthalocyanine, Y-type titanyl phthalocyanine, amorphous titanyl phthalocyanine, and the titanyl phthalocyanine described in Japanese Patent Application Publication No. H8-209023, U.S. Pat. Nos. 5,736,282, and 5,874,570 which has a maximum peak at a Bragg angle 2θ of 9.6° in the CuKα: X-ray diffraction spectrum. The content of the charge generating material is preferably 0.1 to 20 mass % or more preferably 0.5 to 10 mass % of the solids in the monolayer photosensitive layer 3.

A hydrazone compound, pyrazoline compound, pyrazolone compound, oxadiazole compound, oxazole compound, arylamine compound, benzidine compound, stilbene compound or styryl compound or poly-N-vinyl carbazole, polysilane or the like for example can be used as the hole transport material. One of these hole transport materials may be used alone, or two or more may be used in combination. The hole transport material used in the present invention is preferably one that not only has excellent ability to transport the holes generated during light exposure, but is also suitable for combining with the charge generating material. The content of the hole transport material is preferably 3 to 80 mass %, or more preferably 5 to 60 mass % of the solids in the monolayer photosensitive layer 3.

Examples of electron transport materials (acceptor compounds) include succinic anhydride, maleic anhydride, dibromosuccinic anhydride, phthalic anhydride, 3-nitrophthalic anhydride, 4-nitrophthalic anhydride, pyromellitic anhydride, pyromellitic acid, trimellitic acid, trimellitic anhydride, phthalimide, 4-nitrophthalimide, tetracyanoethylene, tetracyanoquinodimethane, chloranil, bromanil, o-nitrobenzoic acid, malononitrile, trinitrofluorenone, trinitrothioxanthone, dinitrobenzene, dinitroanthracene, dinitroacridine, nitroanthraquinone, dinitroanthraquinone and thiopyran compounds, quinone compounds, benzoquinone compounds, diphenoquinone compounds, naphthoquinone compounds, anthraquinone compounds, stilbenequinone compounds, azoquinone compounds and the like. These electron transport materials may be used independently, or two or more may be used in combination. The content of the electron transport material is preferably 1 to 50 mass % or more preferably 5 to 40 mass % of the solids of the monolayer photosensitive layer 3.

Bisphenol A, bisphenol Z, bisphenol A-biphenyl copolymer, bisphenol Z-biphenyl copolymer and various other polycarbonate resins and polyphenylene resin, polyester resin, polyvinyl acetal resin, polyvinyl butyral resin, polyvinyl alcohol resin, vinyl chloride resin, vinyl acetate resin, polyethylene resin, polypropylene resin, acrylic resin, polyurethane resin, epoxy resin, melamine resin, silicone resin, polyamide resin, polystyrene resin, polyacetal resin, polyallylate resin, polysulfone resin and methacrylate ester polymers and copolymers of these and the like can be used as the resin binder of the monolayer photosensitive layer 3. A mixture of resins of the same kind with different molecular weights can also be used.

The content of the resin binder is preferably 10 to 90 mass % or more preferably 20 to 80 mass % of the solids in the monolayer photosensitive layer 3.

The film thickness of the monolayer photosensitive layer 3 is in the range of preferably 3 to 100 μm or more preferably 5 to 40 μm in order to maintain an effective surface potential for practical use.

(Positively Charged Stacked Photoreceptor)

In the positively charged stacked photoreceptor, the charge transport layer 5 is composed principally of a charge transport material and a resin binder. The same materials given as examples above for the charge transport layer 5 of the negatively-charged stacked photoreceptor can be used for the charge transport material and resin binder, without any particular limitations. The content of each material and the thickness of the charge transport layer 5 may also be similar to those in the negatively charged stacked photoreceptor.

The charge generating layer 4 provided on the charge transport layer 5 consists principally of a charge generating material, a hole transport material, an electron transport material (acceptor compound) and a resin binder. The same materials given as examples above for the monolayer photosensitive layer 3 of the monolayer photoreceptor can be used as the charge generating material, hole transport material, electron transport material and resin binder, without any particular limitations. The content of each material and the thickness of the charge generating layer 4 may also be similar to those in the monolayer photosensitive layer 3 of the monolayer photoreceptor.

In the present invention, various additives may be included as necessary in the under coat layer 2, photosensitive layer 3, charge generating layer 4 and charge transport layer 5 with the aim of improving sensitivity, reducing residual potential, improving environmental resistance or stability with respect to harmful light, or improving durability including abrasion resistance. In addition to a compound represented by General Formula (I) in the present invention, additives that can be used include such compounds as succinic anhydride, maleic anhydride, dibromosuccinic anhydride, pyromellitic anhydride, pyromellitic acid, trimellitic acid, trimellitic anhydride, phthalimide, 4-nitrophthalimide, tetracyanoethylene, tetracyanoquinodimethane, chloranil, bromanil, o-nitrobenzoic acid, trinitrofluorenone and the like. An antioxidant, light stabilizer or other deterioration prevention agent can also be added. Compounds that are used for such purposes include, but are not limited to, tocopherol and other chromanol derivatives and ether compounds, ester compounds, polyarylalkane compounds, hydroquinone derivatives, diether compounds, benzophenone derivatives, benzotriazole derivatives, thioether compounds, phenylenediamine derivatives, phosphonic acid esters, phosphorous acid esters, phenol compounds, hindered phenol compounds, linear amine compounds, cyclic amine compounds, hindered amine compounds and the like.

A leveling agent such as silicone oil or a fluorine oil can also be included in the photosensitive layer in order to improve the leveling properties of the formed film and impart greater lubricity. Fine particles of silicon oxide (silica), titanium oxide, zinc oxide, calcium oxide, aluminum oxide (alumina), zirconium oxide and other metal oxides, barium sulfate, calcium sulfate and other metal sulfates, and silicon nitride, and aluminum nitride and other metal nitrides, or ethylene tetrafluoride resin and other fluorine resin particles and fluorine-based comb-shaped graft polymer resins and the like can also be included with the aim of adjusting the film hardness, reducing the friction coefficient and imparting lubricity and the like. Other known additives can also be included as necessary to the extent that they do not detract significantly from the electrophotographic properties.

A surface protective layer 6 can also be provided as necessary on the surface of the photosensitive layer in the present invention with the aim of further improving the environmental resistance and mechanical strength. Surface protective layer 6 is composed of a material with superior environmental resistance and durability with respect to mechanical stress, and preferably has the property of transmitting, with as little loss as possible, the light to which the charge generating layer responds.

The surface protective layer 6 consists of a layer consisting primarily of a resin binder, or an inorganic thin film of amorphous carbon or the like. A metal oxide such as silicon oxide (silica), titanium oxide, zinc oxide, calcium oxide, aluminum oxide (alumina) or zirconium oxide, a metal sulfide such as barium sulfide or calcium sulfide, a metal nitride such as silicon nitride or aluminum nitride, fine particles of a metal oxide, or particles of a fluorine resin such as ethylene tetrafluoride or a fluorine-based comb-shaped graft polymer resin can be included in the resin binder with the aim of improving conductivity, reducing the friction coefficient, and imparting lubricity and the like.

A compound represented by General Formula (I) above of the present invention can also be used in the surface protective layer 6 with the aim of controlling the inflow and outflow of gasses and steam. A charge transport material or electron acceptor used in the aforementioned photosensitive layer may also be included with the aim of imparting charge transport properties, or a leveling agent such as silicone oil or a fluorine oil may be included with the aim of imparting lubricity and improving the leveling properties of the formed film.

The film thickness of the surface protective layer 6 itself depends on the composition of the surface protective layer, and can be set as desired within a range at which there are no adverse effects such as increases residual potential or the like during long-term continuous use.

When manufacturing the photoreceptor of the present invention, a diadamantyl diester compound represented by General Formula (I) above is included in the coating liquid for forming each layer of the photoreceptor. This coating liquid is compatible with a variety of coating methods including dip coating methods and spray coating methods, and is not limited to any particular coating method.

(Electrophotographic Device)

The desired effects of the electrophotographic receptor of the present invention are obtained when it is applied to various machine processes. Specifically, satisfactory effects can be obtained in contact charging systems using rollers, brushes and the like, non-contact charging systems using corotrons, scorotrons and the like and other charging processes, and in non-contact development and contact development processes using non-magnetic single component, magnetic single component, two-component and other developing systems.

Figure 2:
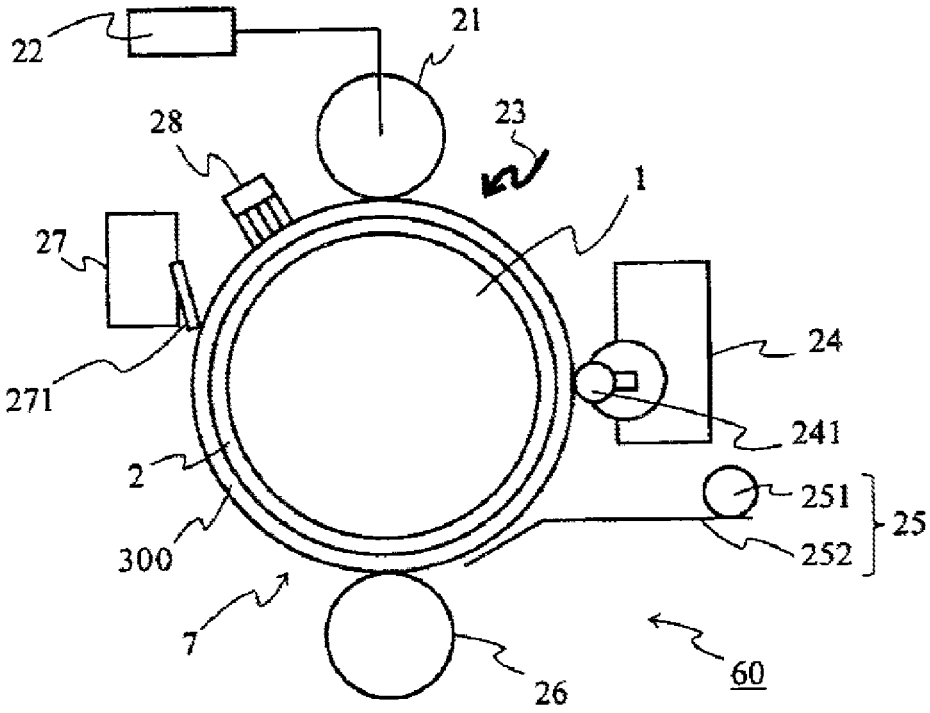
FIG. 2 is a rough diagram showing one example of an electrophotographic device of the present invention.

As one example, FIG. 2 is a rough diagram of an electrophotographic device of the present invention. The electrophotographic device 60 of the present invention is equipped with an electrophotographic photoreceptor 7 of the present invention comprising a conductive base 1 covered on the outer circumference by an under coat layer 2 and a photosensitive layer 300. This electrophotographic device 60 also comprises a roller charging member 21 on the outer edge of the photoreceptor 7, a high-voltage power supply 22 supplying applied voltage to the roller charging member 21, an image exposure member 23, a developer 24 equipped with a developing roller 241, a paper feed member 25 provided with a paper feed roller 251 and a paper feed guide 252, a transfer charger (DC charger) 26, a cleaning mechanism 27 equipped with a cleaning blade 271, and a neutralizing member 28. Electrophotographic device 60 of the present invention may be a color printer.

EXAMPLES

The present invention is explained in more detail below using examples.

Synthesis Examples 19.6 g of sodium hydride were suspended in 70 ml of dehydrated tetrahydrofuran (THF) in a 1000 ml 3-necked flask in a flow of Ar gas, and a solution of 23.10 g of hydroquinone dissolved in 140 ml of dehydrated THF was dripped in. After dripping, this was reacted for 8 hours at 50° C. and cooled to room temperature, and a solution of 97.3 g of adamantane carboxylic acid chloride dissolved in 280 ml of dehydrated THF was dripped in slowly, after which 70 ml of tetraethylamine was added. After being reacted for one day at 60° C., this was concentrated under reduced pressure, and the reaction liquid was washed three times with 1000 ml of ion-exchange water. This was recrystallized three times with THF, and purified to obtain 41.9 g of the target compound represented by Formula (I-1).

Figure 3:
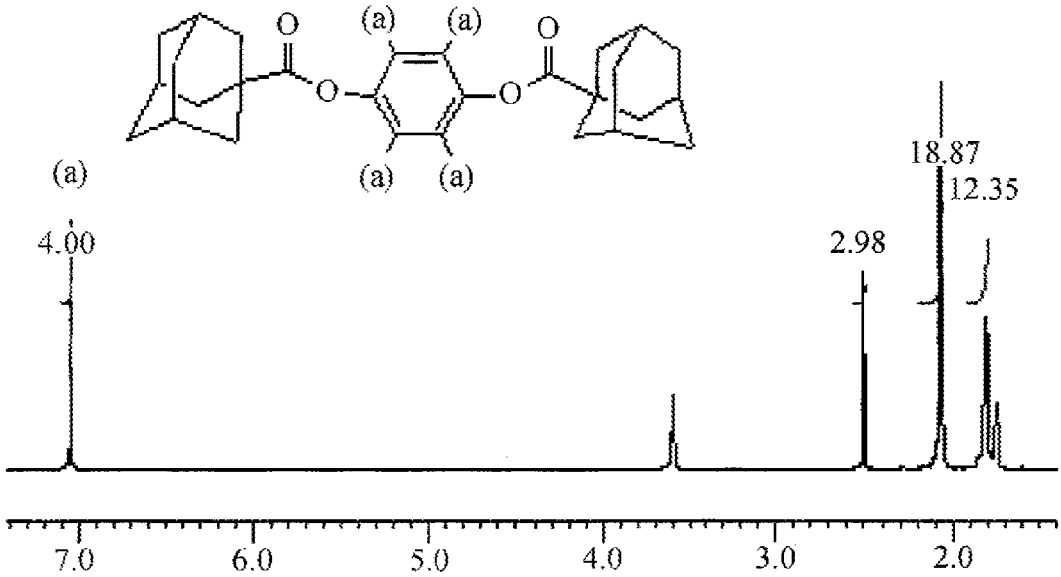
FIG. 3 is an NMR spectrum chart of a diadamantyl diester compound represented by Formula (I-1) in the present invention.

The structure of the resulting compound was verified by mechanical analysis of the NMR spectrum, mass analysis spectrum, infrared spectrum and the like. FIG. 3 shows the NMR spectrum chart for this compound.

Manufacturing examples: negatively charged stacked photoreceptor

Example 1

A coating liquid prepared by dissolving and dispersing 5 mass parts of alcohol-soluble nylon (Amilan CM8000®, Tohray) with 5 mass parts of aminosilane-treated titanium oxide fine particles in 90 mass parts of methanol was dip coated as an under coat layer on the outer circumference of an aluminum cylinder with an outer diameter of 30 mm as a conductive base, and dried for 30 minutes at 100° C. to form an under coat layer with a film thickness of about 2 μm.

1.5 mass parts of the Y-type titanyl phthalocyanine described in Japanese Patent Application Publication No. S64-17066 or U.S. Pat. No. 4,898,799 as a charge generating material and 1.5 mass parts of polyvinyl butyral (Eslec®B BX-1, manufactured by Sekisui Chemical) as a resin binder were dispersed in 60 mass parts of a mixture of equal parts of dichloromethane and dichloroethane for 1 hour in a sand mill disperser to prepare a coating liquid, which was then dip coated on the aforementioned under coat layer, and dried for 30 minutes at 80° C. to form a charge generating layer with a film thickness of about 0.3 μm.

A coating liquid prepared by dissolving 100 mass parts of the compound represented by structural formula (II-1) above as a charge transport material together with 100 mass parts of polycarbonate resin (Panlite TS-2050®, Teijin Chemicals Ltd.) in 900 mass parts of dichloromethane and then adding 0.1 mass parts of silicone oil (KP-340, Shinetsu Polymer) followed by 10 mass parts of the compound represented by Formula (I-1) above was coated on this charge generating layer to form a film, which was then dried for 60 minutes at 90° C. to form a charge transport layer with a film thickness of about 25 μm and prepare an electrophotographic photoreceptor.

Examples 2 to 76

Electrophotographic photoreceptors were prepared as in Example 1 except that the compounds represented by Formulae (I-2) to (1-76) above were substituted for the compound represented by Formula (I-1) above.

Example 77

An electrophotographic photoreceptor was prepared as in Example 1 except that the added amount of the compound represented by Formula (I-1) above was changed to 1.0 mass part.

Example 78

An electrophotographic photoreceptor was prepared as in Example 1 except that the added amount of the compound represented by Formula (I-1) above was changed to 3.0 mass parts.

Example 79

An electrophotographic photoreceptor was prepared as in Example 1 except that the added amount of the compound represented by Formula (I-1) above was changed to 6.0 mass parts.

Example 80

An electrophotographic photoreceptor was prepared as in Example 1 except that the compound represented by Formula (I-1) above was not added to the charge transport layer, and instead 3.0 mass parts thereof were added to the under coat layer.

Example 81

An electrophotographic photoreceptor was prepared as in Example 1 except that the compound represented by Formula (I-1) above was not added to the charge transport layer, and instead 3.0 mass parts thereof were added to the charge generating layer.

Example 82

A charge transport layer was formed as in Example 1 except that the compound represented by Formula (I-1) and the silicone oil were excluded from the charge transport layer coating liquid used in Example 1, and the charge transport layer was formed with a film thickness of 20 μm. Next, a coating liquid prepared by dissolving 80 mass parts of the compound represented by Structural Formula (II-1) above as a charge transport material together with 120 mass parts of polycarbonate resin (PCZ-500, Mitsubishi Gas chemical) as a resin binder in 900 mass parts of dichloromethane and then adding 0.1 mass parts of silicone oil (KP-340, Shinetsu Polymer) and 12 mass parts of the compound represented by Formula (I-1) above was coated over this layer to form a film which was then dried for 60 minutes at 90° C. to form a surface protective layer with a film thickness of about 10 μm and prepare an electrophotographic photoreceptor.

Example 83

An electrophotographic photoreceptor was prepared as in Example 1 except that the compound represented by Formula (I-1) above was not added to the charge transport layer, and instead 3.0 mass parts thereof were added to the under coat layer and 1.0 mass part thereof to the charge generating layer.

Example 84

An electrophotographic photoreceptor was prepared as in Example 1 except that 3.0 mass parts of the compound represented by Formula (I-1) above were added to the under coat layer, and the amount of the compound represented by Formula (I-1) that was added to the charge transport layer was changed to 3.0 mass parts.

Example 85

An electrophotographic photoreceptor was prepared as in Example 1 except that 3.0 mass parts of the compound represented by Formula (I-1) above were added to the charge generating layer, and the amount of the compound represented by Formula (I-1) that was added to the charge transport layer was changed to 3.0 mass parts.

Example 86

An electrophotographic photoreceptor was prepared as in Example 1 except that 3.0 mass parts of the compound represented by Formula (I-1) above were added to the under coat layer, 1.0 mass part was added to the charge generating layer, and the amount of the compound represented by Formula (I-1) that was added to the charge transport layer was changed to 3.0 mass parts.

Example 87

An electrophotographic photoreceptor was prepared as in Example 1 except that the α-type titanyl phthalocyanine described in Japanese Patent Application Publication No. 61-217050 or U.S. Pat. No. 4,728,592 was substituted for the charge generating material used in Example 1.

Example 88

An electrophotographic photoreceptor was prepared as in Example 1 except that an X-type metal-free phthalocyanine (Dainippon Ink and Chemicals, Fastogen Blue 8120B) was substituted for the charge generating material used in Example 1.

Comparative Example 1

An electrophotographic photoreceptor was prepared as in Example 1 except that the compound represented by Formula (I-1) was not added to the charge transport layer.

Comparative Example 2

An electrophotographic photoreceptor was prepared as in Example 1 except that the compound represented by Formula (I-1) was not added to the charge transport layer, and the amount of resin binder used in the charge transport layer was increased to 110 mass parts.

Comparative Example 3

An electrophotographic photoreceptor was prepared as in Example 1 except that the compound represented by Formula (I-1) was not added to the charge transport layer, and 10 mass parts of dioctyl phthalate (Wako Pure Chemical Industries) were added instead.

Comparative Example 4

An electrophotographic photoreceptor was prepared as in Example 87 except that the compound represented by Formula (I-1) was not used.

Comparative Example 5

An electrophotographic photoreceptor was prepared as in Example 88 except that the compound represented by Formula (I-1) was not used.

The photoreceptors prepared in Examples 1 to 88 and Comparative Examples 1 to 5 above were mounted on an HP LJ4250, and evaluated by the following methods. First, the photoreceptor surface was charged to −650 V by corona discharge in a dark place, and the surface potential V0 immediately after charging was measured. Next, this photoreceptor was left for 5 seconds in a dark place, the surface potential V5 was measured, and the potential retention rate Vk5(%) 5 seconds after charging was determined according to the following Formula:

$$Vk_5 = V5/V0 \times 100.$$

Once the surface potential had reached −600 V, the photoreceptor was exposed for 5 seconds to exposure light dispersed to 780 nm with a filter using a halogen lamp as the light source, and the quantity of light exposure required for the surface potential to decay to −300 V was given as E1/2 ($\mu Jcm^{-2}$), while the amount of exposure required for it to decay to −50 V was given as sensitivity E50 ($\mu Jcm^{-2}$).

The photoreceptors prepared in Examples 1 to 88 and Comparative Examples 1 to 5 above were also installed in an ozone exposure device in which the photoreceptor could be left in an ozone atmosphere, and exposed to ozone for 2 hours at 100 ppm, the potential retention rates were measured again, and the degree of change in the retention rate Vk5 after ozone exposure was determined and given as a percentage as the ozone exposure retention change rate (ΔVk5). The ozone exposure retention change rate was determined by the following formula given $Vk5_1$, as the retention rate before ozone exposure and $Vk5_2$ as the retention rate after ozone exposure:

$$\Delta Vk5 = Vk5_2 \text{ (after ozone exposure)}/Vk5_1, \text{ (before ozone exposure)}$$

The aforementioned measurement results are given in the following tables as the electrical characteristics of the photoreceptors of Examples 1 to 88 and Comparative Examples 1 to 5.

TABLE 4

| | Charge generating material*2 | Additives (mass parts) Under coat layer | Charge generating layer | Charge transport layer | Surface protective layer | Charge transport material | Vk5 (%) | E½ ($\mu Jcm^{-2}$) | E50 ($\mu Jcm^{-2}$) | Ozone exposure retention change rate ΔVk5 (%) |
|---|---|---|---|---|---|---|---|---|---|---|
| Ex 1 | Y-TiOPc | — | — | I-1 (10) | / | II-1 | 94.7 | 0.16 | 1.06 | 96.8 |
| Ex 2 | Y-TiOPc | — | — | I-2 (10) | / | II-1 | 92.7 | 0.15 | 0.93 | 96.1 |
| Ex 3 | Y-TiOPc | — | — | I-3 (10) | / | II-1 | 95.3 | 0.17 | 1.02 | 96.2 |
| Ex 4 | Y-TiOPc | — | — | I-4 (10) | / | II-1 | 93.2 | 0.15 | 1.10 | 98.7 |
| Ex 5 | Y-TiOPc | — | — | I-5 (10) | / | II-1 | 93.4 | 0.15 | 1.04 | 98.2 |

TABLE 4-continued

| | Charge generating material*2 | Additives (mass parts) Under coat layer | Charge generating layer | Charge transport layer | Surface protective layer | Charge transport material | Vk5 (%) | E½ (μJcm$^{-2}$) | E50 (μJcm$^{-2}$) | Ozone exposure retention change rate ΔVk5 (%) |
|---|---|---|---|---|---|---|---|---|---|---|
| Ex 6 | Y-TiOPc | — | — | I-6 (10) | / | II-1 | 93.2 | 0.12 | 0.98 | 97.0 |
| Ex 7 | Y-TiOPc | — | — | I-7 (10) | / | II-1 | 92.9 | 0.16 | 1.20 | 94.6 |
| Ex 8 | Y-TiOPc | — | — | I-8 (10) | / | II-1 | 94.2 | 0.14 | 0.99 | 94.9 |
| Ex 9 | Y-TiOPc | — | — | I-9 (10) | / | II-1 | 94.9 | 0.16 | 1.06 | 96.7 |
| Ex 10 | Y-TiOPc | — | — | I-10 (10) | / | II-1 | 94.3 | 0.17 | 1.20 | 96.4 |
| Ex 11 | Y-TiOPc | — | — | I-11 (10) | / | II-1 | 94.8 | 0.16 | 1.11 | 98.1 |
| Ex 12 | Y-TiOPc | — | — | I-12 (10) | / | II-1 | 95.5 | 0.14 | 1.07 | 96.3 |
| Ex 13 | Y-TiOPc | — | — | I-13 (10) | / | II-1 | 94.6 | 0.16 | 1.03 | 96.7 |
| Ex 14 | Y-TiOPc | — | — | I-14 (10) | / | II-1 | 94.3 | 0.14 | 1.08 | 96.6 |
| Ex 15 | Y-TiOPc | — | — | I-15 (10) | / | II-1 | 94.7 | 0.16 | 0.95 | 96.2 |
| Ex 16 | Y-TiOPc | — | — | I-16 (10) | / | II-1 | 93.3 | 0.17 | 1.06 | 96.4 |
| Ex 17 | Y-TiOPc | — | — | I-17 (10) | / | II-1 | 93.2 | 0.15 | 1.08 | 98.2 |
| Ex 18 | Y-TiOPc | — | — | I-18 (10) | / | II-1 | 95.4 | 0.14 | 1.17 | 98.1 |
| Ex 19 | Y-TiOPc | — | — | I-19 (10) | / | II-1 | 93.2 | 0.12 | 0.96 | 97.0 |
| Ex 20 | Y-TiOPc | — | — | I-20 (10) | / | II-1 | 94.9 | 0.16 | 1.12 | 94.9 |
| Ex 21 | Y-TiOPc | — | — | I-21 (10) | / | II-1 | 94.2 | 0.15 | 0.99 | 94.7 |
| Ex 22 | Y-TiOPc | — | — | I-22 (10) | / | II-1 | 94.9 | 0.16 | 1.09 | 96.8 |
| Ex 23 | Y-TiOPc | — | — | I-23 (10) | / | II-1 | 94.6 | 0.17 | 1.02 | 96.9 |
| Ex 24 | Y-TiOPc | — | — | I-24 (10) | / | II-1 | 93.2 | 0.17 | 1.06 | 98.1 |
| Ex 25 | Y-TiOPc | — | — | I-25 (10) | / | II-1 | 94.1 | 0.15 | 1.13 | 96.4 |
| Ex 26 | Y-TiOPc | — | — | I-26 (10) | / | II-1 | 94.2 | 0.16 | 1.02 | 96.5 |

TABLE 5

| | Charge generating material*2 | Additives (mass parts) Under coat layer | Charge generating layer | Charge transport layer | Surface protective layer | Charge transport material | Vk5 (%) | E½ (μJcm$^{-2}$) | E50 (μJcm$^{-2}$) | Ozone exposure retention change rate ΔVk5 (%) |
|---|---|---|---|---|---|---|---|---|---|---|
| Ex 27 | Y-TiOPc | — | — | I-27 (10) | / | II-1 | 94.7 | 0.16 | 1.06 | 96.8 |
| Ex 28 | Y-TiOPc | — | — | I-28 (10) | / | II-1 | 92.7 | 0.15 | 0.93 | 96.1 |
| Ex 29 | Y-TiOPc | — | — | I-29 (10) | / | II-1 | 95.3 | 0.17 | 1.02 | 96.2 |
| Ex 30 | Y-TiOPc | — | — | I-30 (10) | / | II-1 | 93.2 | 0.15 | 1.10 | 98.7 |
| Ex 31 | Y-TiOPc | — | — | I-31 (10) | / | II-1 | 93.4 | 0.15 | 1.04 | 98.2 |
| Ex 32 | Y-TiOPc | — | — | I-32 (10) | / | II-1 | 93.2 | 0.12 | 0.98 | 97.0 |
| Ex 33 | Y-TiOPc | — | — | I-33 (10) | / | II-1 | 92.9 | 0.16 | 1.20 | 94.6 |
| Ex 34 | Y-TiOPc | — | — | I-34 (10) | / | II-1 | 94.2 | 0.14 | 0.99 | 94.9 |
| Ex 35 | Y-TiOPc | — | — | I-35 (10) | / | II-1 | 94.9 | 0.16 | 1.06 | 96.7 |
| Ex 36 | Y-TiOPc | — | — | I-36 (10) | / | II-1 | 94.3 | 0.17 | 1.20 | 96.4 |
| Ex 37 | Y-TiOPc | — | — | I-37 (10) | / | II-1 | 94.8 | 0.16 | 1.11 | 98.1 |
| Ex 38 | Y-TiOPc | — | — | I-38 (10) | / | II-1 | 95.5 | 0.14 | 1.07 | 96.3 |
| Ex 39 | Y-TiOPc | — | — | I-39 (10) | / | II-1 | 94.6 | 0.16 | 1.03 | 96.7 |
| Ex 40 | Y-TiOPc | — | — | I-40 (10) | / | II-1 | 94.9 | 0.14 | 1.08 | 96.6 |
| Ex 41 | Y-TiOPc | — | — | I-41 (10) | / | II-1 | 94.7 | 0.16 | 0.95 | 96.2 |
| Ex 42 | Y-TiOPc | — | — | I-42 (10) | / | II-1 | 94.7 | 0.16 | 1.06 | 96.8 |
| Ex 43 | Y-TiOPc | — | — | I-43 (10) | / | II-1 | 92.7 | 0.15 | 0.93 | 96.1 |
| Ex 44 | Y-TiOPc | — | — | I-44 (10) | / | II-1 | 95.3 | 0.17 | 1.02 | 96.2 |
| Ex 45 | Y-TiOPc | — | — | I-45 (10) | / | II-1 | 93.2 | 0.15 | 1.10 | 98.7 |
| Ex 46 | Y-TiOPc | — | — | I-46 (10) | / | II-1 | 93.4 | 0.15 | 1.04 | 98.2 |
| Ex 47 | Y-TiOPc | — | — | I-47 (10) | / | II-1 | 93.2 | 0.12 | 0.98 | 97.0 |
| Ex 48 | Y-TiOPc | — | — | I-48 (10) | / | II-1 | 92.9 | 0.16 | 1.20 | 94.6 |
| Ex 49 | Y-TiOPc | — | — | I-49 (10) | / | II-1 | 94.2 | 0.14 | 0.99 | 94.9 |
| Ex 50 | Y-TiOPc | — | — | I-50 (10) | / | II-1 | 94.9 | 0.16 | 1.06 | 96.7 |
| Ex 51 | Y-TiOPc | — | — | I-51 (10) | / | II-1 | 94.3 | 0.17 | 1.20 | 96.4 |

TABLE 6

| | Charge generating material*2 | Additives (mass parts) Under coat layer | Charge generating layer | Charge transport layer | Surface protective layer | Charge transport material | Vk5 (%) | E½ (μJcm$^{-2}$) | E50 (μJcm$^{-2}$) | Ozone exposure retention change rate ΔVk5 (%) |
|---|---|---|---|---|---|---|---|---|---|---|
| Ex 52 | Y-TiOPc | — | — | I-52 (10) | / | II-1 | 94.8 | 0.16 | 1.11 | 98.1 |
| Ex 53 | Y-TiOPc | — | — | I-53 (10) | / | II-1 | 95.5 | 0.14 | 1.07 | 96.3 |

TABLE 6-continued

| | Charge generating material*2 | Additives (mass parts) Under coat layer | Charge generating layer | Charge transport layer | Surface protective layer | Charge transport material | Vk5 (%) | E½ (μJcm$^{-2}$) | E50 (μJcm$^{-2}$) | Ozone exposure retention change rate ΔVk5 (%) |
|---|---|---|---|---|---|---|---|---|---|---|
| Ex 54 | Y-TiOPc | — | — | I-54 (10) | / | II-1 | 94.6 | 0.16 | 1.03 | 96.7 |
| Ex 55 | Y-TiOPc | — | — | I-55 (10) | / | II-1 | 95.9 | 0.14 | 1.08 | 96.6 |
| Ex 56 | Y-TiOPc | — | — | I-56 (10) | / | II-1 | 93.2 | 0.15 | 1.10 | 98.7 |
| Ex 57 | Y-TiOPc | — | — | I-57 (10) | / | II-1 | 93.4 | 0.15 | 1.04 | 98.2 |
| Ex 58 | Y-TiOPc | — | — | I-58 (10) | / | II-1 | 93.2 | 0.12 | 0.98 | 97.0 |
| Ex 59 | Y-TiOPc | — | — | I-59 (10) | / | II-1 | 94.3 | 0.17 | 1.20 | 96.4 |
| Ex 60 | Y-TiOPc | — | — | I-60 (10) | / | II-1 | 94.8 | 0.16 | 1.11 | 98.1 |
| Ex 61 | Y-TiOPc | — | — | I-61 (10) | / | II-1 | 95.5 | 0.14 | 1.07 | 96.3 |
| Ex 62 | Y-TiOPc | — | — | I-62 (10) | / | II-1 | 94.6 | 0.16 | 1.03 | 96.7 |
| Ex 63 | Y-TiOPc | — | — | I-63 (10) | / | II-1 | 94.9 | 0.14 | 1.08 | 96.6 |
| Ex 64 | Y-TiOPc | — | — | I-64 (10) | / | II-1 | 94.7 | 0.16 | 0.95 | 96.2 |
| Ex 65 | Y-TiOPc | — | — | I-65 (10) | / | II-1 | 94.7 | 0.16 | 1.06 | 96.8 |
| Ex 66 | Y-TiOPc | — | — | I-66 (10) | / | II-1 | 92.7 | 0.15 | 0.93 | 96.1 |
| Ex 67 | Y-TiOPc | — | — | I-67 (10) | / | II-1 | 95.3 | 0.17 | 1.02 | 96.2 |
| Ex 68 | Y-TiOPc | — | — | I-68 (10) | / | II-1 | 93.2 | 0.15 | 1.10 | 98.7 |
| Ex 69 | Y-TiOPc | — | — | I-69 (10) | / | II-1 | 93.4 | 0.15 | 1.04 | 98.2 |
| Ex 70 | Y-TiOPc | — | — | I-70 (10) | / | II-1 | 93.2 | 0.12 | 0.98 | 97.0 |
| Ex 71 | Y-TiOPc | — | — | I-71 (10) | / | II-1 | 94.3 | 0.17 | 1.20 | 96.4 |
| Ex 72 | Y-TiOPc | — | — | I-72 (10) | / | II-1 | 94.8 | 0.16 | 1.11 | 98.1 |
| Ex 73 | Y-TiOPc | — | — | I-73 (10) | / | II-1 | 95.5 | 0.14 | 1.07 | 96.3 |
| Ex 74 | Y-TiOPc | — | — | I-74 (10) | / | II-1 | 94.6 | 0.16 | 1.03 | 96.7 |
| Ex 75 | Y-TiOPc | — | — | I-75 (10) | / | II-1 | 94.9 | 0.14 | 1.08 | 96.6 |
| Ex 76 | Y-TiOPc | — | — | I-76 (10) | / | II-1 | 94.7 | 0.16 | 0.95 | 96.2 |

TABLE 7

| | Charge generating material*2 | Additives (mass parts) Under coat layer | Charge generating layer | Charge transport layer | Surface protective layer | Charge transport material | Vk5 (%) | E½ (μJcm$^{-2}$) | E50 (μJcm$^{-2}$) | Ozone exposure retention change rate ΔVk5 (%) |
|---|---|---|---|---|---|---|---|---|---|---|
| Ex 77 | Y-TiOPc | — | — | I-1 (1) | / | II-1 | 94.7 | 0.16 | 1.06 | 96.8 |
| Ex 78 | Y-TiOPc | — | — | I-1 (3) | / | II-1 | 92.7 | 0.15 | 0.93 | 96.1 |
| Ex 79 | Y-TiOPc | — | — | I-1 (6) | / | II-1 | 95.3 | 0.17 | 1.02 | 96.2 |
| Ex 80 | Y-TiOPc | I-1 (3) | — | — | / | II-1 | 93.2 | 0.15 | 1.10 | 98.7 |
| Ex 81 | Y-TiOPc | — | I-1 (3) | — | / | II-1 | 93.4 | 0.15 | 1.04 | 98.2 |
| Ex 82 | Y-TiOPc | — | — | — | I-1 (12) | II-1 | 93.2 | 0.12 | 0.98 | 97.0 |
| Ex 83 | Y-TiOPc | I-1 (3) | I-1 (1) | — | / | II-1 | 94.7 | 0.16 | 0.95 | 96.2 |
| Ex 84 | Y-TiOPc | I-1 (3) | — | I-1 (3) | / | II-1 | 94.7 | 0.16 | 1.06 | 96.8 |
| Ex 85 | Y-TiOPc | — | I-1 (3) | I-1 (3) | / | II-1 | 94.7 | 0.16 | 1.06 | 96.8 |
| Ex 86 | Y-TiOPc | I-1 (3) | I-1 (1) | I-1 (3) | / | II-1 | 94.3 | 0.17 | 1.20 | 96.4 |
| Ex 87 | α-TiOPc | — | — | I-1 (10) | / | II-1 | 94.8 | 0.16 | 1.11 | 98.1 |
| Ex 88 | X-$H_2$Pc | — | — | I-1 (10) | / | II-1 | 95.5 | 0.14 | 1.07 | 96.3 |
| CE 1 | Y-TiOPc | — | — | — | / | II-1 | 93.2 | 0.28 | 2.25 | 76.3 |
| CE 2 | Y-TiOPc | — | — | — | / | II-1 | 94.0 | 0.31 | 2.94 | 76.2 |
| CE 3 | Y-TiOPc | — | — | Dioctyl phthalate (10) | / | II-1 | 94.1 | 0.27 | 2.62 | 76.5 |
| CE 4 | α-TiOPc | — | — | — | / | II-1 | 95.3 | 0.35 | 3.02 | 79.2 |
| CE 5 | X-$H_2$Pc | — | — | — | / | II-1 | 93.7 | 0.33 | 2.95 | 77.8 |

*2Y-TiOPc represents Y-type titanyl phthalocyanine, α-TiOPc represents α-type titanyl phthalocyanine, and X-$H_2$Pc represents X-type metal-free titanyl phthalocyanine.

It can be seen from the results in the tables above that even when the compound of the present invention was used as an additive in the various layers making up the photoreceptor, the initial electrical characteristics were not greatly affected, and fluctuation in the retention rate after ozone exposure was controlled.

On the other hand, in Comparative Example 2 in which more of the resin binder was used in the charge transport layer instead of adding the compound of the present invention, sensitivity was somewhat delayed, and there was more change in the retention rate after ozone exposure. This shows that the effects of using the compound of the present invention cannot be achieved simply by increasing the amount of the resin binder in the charge transport layer.

Moreover, there was also little change in the initial sensitivity from using the compound of the present invention when a different phthalocyanine was used in the charge generating layer, and the change in the retention rate after ozone exposure was also controlled.

Next, the photoreceptors prepared in Examples 1 to 88 and Comparative Examples 1 to 5 above were mounted in a two-component developing system digital copier (Canon Image Runner color 2880) that had been modified so that the surface potential of the photoreceptor could be measured, and the potential stability, image memory, and amount of film loss from the photosensitive layer due to friction with the paper and blade were measured before and after 100,000 sheets were printed on the copier. The results are shown in the tables below.

For the image evaluation, image samples having a checker flag pattern in the first half and halftone in the second half were evaluated, and the presence or absence of image memory from the checker flag pattern in the half-tone part was noted. The results were given as O if no memory was observed, Δ if some memory was observed and × if the memory was obvious, and as "pos" if the dark and light areas appeared the same as in the original image, or "neg" if the dark and light areas were reversed from the original image.

TABLE 8

| | Initial bright part potential (−V) | Initial image memory evaluation | Bright part potential after 100,000 sheets (−V) | Change in bright part potential (−V) | Image memory after repeated printing evaluation | Photosensitive layer film loss after printing (μm) |
|---|---|---|---|---|---|---|
| Ex 1 | 113 | ○ | 122 | 9 | ○ | 2.13 |
| Ex 2 | 120 | ○ | 132 | 12 | ○ | 2.14 |
| Ex 3 | 115 | ○ | 120 | 5 | ○ | 2.11 |
| Ex 4 | 116 | ○ | 121 | 5 | ○ | 2.12 |
| Ex 5 | 131 | ○ | 136 | 5 | ○ | 2.12 |
| Ex 6 | 132 | ○ | 132 | 0 | ○ | 2.14 |
| Ex 7 | 116 | ○ | 121 | 5 | ○ | 2.15 |
| Ex 8 | 128 | ○ | 131 | 3 | ○ | 2.09 |
| Ex 9 | 125 | ○ | 135 | 10 | ○ | 2.11 |
| Ex 10 | 132 | ○ | 138 | 6 | ○ | 2.14 |
| Ex 11 | 127 | ○ | 138 | 11 | ○ | 2.08 |
| Ex 12 | 119 | ○ | 128 | 9 | ○ | 2.12 |
| Ex 13 | 128 | ○ | 136 | 8 | ○ | 2.14 |
| Ex 14 | 112 | ○ | 119 | 7 | ○ | 2.12 |
| Ex 15 | 122 | ○ | 127 | 5 | ○ | 2.11 |
| Ex 16 | 130 | ○ | 137 | 7 | ○ | 2.12 |
| Ex 17 | 135 | ○ | 144 | 9 | ○ | 2.15 |
| Ex 18 | 119 | ○ | 124 | 5 | ○ | 2.11 |
| Ex 19 | 125 | ○ | 133 | 8 | ○ | 2.09 |
| Ex 20 | 127 | ○ | 131 | 4 | ○ | 2.13 |
| Ex 21 | 132 | ○ | 138 | 6 | ○ | 2.1 |
| Ex 22 | 135 | ○ | 140 | 5 | ○ | 2.11 |
| Ex 23 | 118 | ○ | 127 | 9 | ○ | 2.13 |
| Ex 24 | 120 | ○ | 128 | 8 | ○ | 2.12 |
| Ex 25 | 118 | ○ | 128 | 10 | ○ | 2.13 |
| Ex 26 | 129 | ○ | 139 | 10 | ○ | 2.13 |

TABLE 9

| | Initial bright part potential (−V) | Initial image memory evaluation | Bright part potential after 100,000 sheets (−V) | Change in bright part potential (−V) | Image memory after repeated printing evaluation | Photosensitive layer film loss after printing (μm) |
|---|---|---|---|---|---|---|
| Ex 27 | 125 | ○ | 137 | 12 | ○ | 2.15 |
| Ex 28 | 132 | ○ | 140 | 8 | ○ | 2.11 |
| Ex 29 | 118 | ○ | 124 | 6 | ○ | 2.13 |
| Ex 30 | 129 | ○ | 133 | 4 | ○ | 2.15 |
| Ex 31 | 121 | ○ | 131 | 10 | ○ | 2.12 |
| Ex 32 | 132 | ○ | 138 | 6 | ○ | 2.11 |
| Ex 33 | 137 | ○ | 142 | 5 | ○ | 2.12 |
| Ex 34 | 129 | ○ | 136 | 7 | ○ | 2.09 |
| Ex 35 | 126 | ○ | 132 | 6 | ○ | 2.12 |
| Ex 36 | 131 | ○ | 137 | 6 | ○ | 2.11 |
| Ex 37 | 141 | ○ | 147 | 6 | ○ | 2.33 |
| Ex 38 | 111 | ○ | 124 | 13 | ○ | 2.13 |
| Ex 39 | 122 | ○ | 130 | 8 | ○ | 2.15 |
| Ex 40 | 114 | ○ | 123 | 9 | ○ | 2.11 |
| Ex 41 | 117 | ○ | 127 | 10 | ○ | 2.10 |
| Ex 42 | 130 | ○ | 130 | 0 | ○ | 2.08 |
| Ex 43 | 133 | ○ | 134 | 1 | ○ | 2.12 |
| Ex 44 | 119 | ○ | 124 | 5 | ○ | 2.13 |
| Ex 45 | 127 | ○ | 133 | 6 | ○ | 2.17 |
| Ex 46 | 124 | ○ | 132 | 8 | ○ | 2.16 |
| Ex 47 | 131 | ○ | 135 | 4 | ○ | 2.18 |
| Ex 48 | 128 | ○ | 133 | 5 | ○ | 2.15 |
| Ex 49 | 116 | ○ | 124 | 8 | ○ | 2.23 |
| Ex 50 | 126 | ○ | 136 | 10 | ○ | 2.19 |
| Ex 51 | 114 | ○ | 124 | 10 | ○ | 2.21 |

TABLE 10

| | Initial bright part potential (−V) | Initial image memory evaluation | Bright part potential after 100,000 sheets (−V) | Change in bright part potential (−V) | Image memory after repeated printing evaluation | Photosensitive layer film loss after printing (μm) |
|---|---|---|---|---|---|---|
| Ex 52 | 124 | ○ | 129 | 5 | ○ | 2.18 |
| Ex 53 | 129 | ○ | 136 | 7 | ○ | 2.25 |
| Ex 54 | 134 | ○ | 142 | 8 | ○ | 2.19 |
| Ex 55 | 119 | ○ | 125 | 6 | ○ | 2.18 |
| Ex 56 | 127 | ○ | 134 | 7 | ○ | 2.17 |
| Ex 57 | 123 | ○ | 133 | 10 | ○ | 2.05 |
| Ex 58 | 130 | ○ | 137 | 7 | ○ | 2.18 |
| Ex 59 | 131 | ○ | 139 | 8 | ○ | 2.19 |
| Ex 60 | 115 | ○ | 128 | 13 | ○ | 2.30 |
| Ex 61 | 119 | ○ | 124 | 5 | ○ | 2.18 |
| Ex 62 | 117 | ○ | 125 | 8 | ○ | 2.11 |
| Ex 63 | 127 | ○ | 135 | 8 | ○ | 2.10 |
| Ex 64 | 128 | ○ | 136 | 8 | ○ | 2.12 |
| Ex 65 | 134 | ○ | 139 | 5 | ○ | 2.17 |
| Ex 66 | 119 | ○ | 124 | 5 | ○ | 2.18 |
| Ex 67 | 128 | ○ | 134 | 6 | ○ | 2.11 |
| Ex 68 | 125 | ○ | 132 | 7 | ○ | 2.16 |
| Ex 69 | 131 | ○ | 136 | 5 | ○ | 2.13 |
| Ex 70 | 132 | ○ | 140 | 8 | ○ | 2.19 |
| Ex 71 | 122 | ○ | 131 | 9 | ○ | 2.06 |
| Ex 72 | 125 | ○ | 133 | 8 | ○ | 2.18 |
| Ex 73 | 130 | ○ | 135 | 5 | ○ | 2.21 |
| Ex 74 | 125 | ○ | 129 | 4 | ○ | 2.23 |
| Ex 75 | 118 | ○ | 125 | 7 | ○ | 2.18 |
| Ex 76 | 125 | ○ | 133 | 8 | ○ | 2.14 |

TABLE 11

| | Initial bright part potential (−V) | Initial image memory evaluation | Bright part potential after 100,000 sheets (−V) | Change in bright part potential (−V) | Image memory after repeated printing evaluation | Photosensitive layer film loss after printing (μm) |
|---|---|---|---|---|---|---|
| Ex 77 | 118 | ○ | 121 | 3 | ○ | 2.36 |
| Ex 78 | 115 | ○ | 125 | 10 | ○ | 2.30 |
| Ex 79 | 132 | ○ | 137 | 5 | ○ | 2.27 |
| Ex 80 | 134 | ○ | 139 | 5 | ○ | 2.19 |
| Ex 81 | 119 | ○ | 126 | 7 | ○ | 2.15 |
| Ex 82 | 124 | ○ | 133 | 9 | ○ | 2.09 |
| Ex 83 | 121 | ○ | 130 | 9 | ○ | 2.18 |
| Ex 84 | 135 | ○ | 139 | 4 | ○ | 2.24 |
| Ex 85 | 129 | ○ | 137 | 8 | ○ | 2.06 |
| Ex 86 | 121 | ○ | 127 | 6 | ○ | 2.15 |
| Ex 87 | 125 | ○ | 133 | 8 | ○ | 2.14 |
| Ex 88 | 118 | ○ | 123 | 5 | ○ | 2.20 |
| CE 1 | 136 | ○ | 146 | 10 | ○ | 4.35 |
| CE 2 | 136 | ○ | 145 | 9 | ○ | 4.75 |
| CE 3 | 123 | ○ | 136 | 13 | ○ | 4.41 |
| CE 4 | 226 | ○ | 229 | 3 | ○ | 4.37 |
| CE 5 | 238 | ○ | 249 | 11 | ○ | 4.46 |

The results in the tables above show no great difference in the initial actual electrical characteristics depending on whether or not the compound of the present invention was added to each layer, and the amount of film loss after repeated printing of 100,000 sheets was reduced by 50% or more. No problems were observed in the potential and image evaluations after printing.

Next, the potential characteristics of the photoreceptors were investigated in different environments ranging from low temperature, low humidity to high temperature, high humidity, and an image evaluation was performed at the same time. The results are shown in the tables below.

TABLE 12

| | Low temperature, low humidity*3 (−V) | Normal temperature, normal humidity*4 (−V) | High temperature, high humidity*5 (−V) | Residual potential difference between LTLH and HTHH (−V) | HTHH memory evaluation | LTLH memory evaluation |
|---|---|---|---|---|---|---|
| Ex 1 | 135 | 114 | 54 | 81 | ○ | ○ |
| Ex 2 | 151 | 123 | 72 | 79 | ○ | ○ |
| Ex 3 | 145 | 115 | 52 | 93 | ○ | ○ |
| Ex 4 | 136 | 124 | 56 | 80 | ○ | ○ |

TABLE 12-continued

| | Low temperature, low humidity*3 (−V) | Normal temperature, normal humidity*4 (−V) | High temperature, high humidity*5 (−V) | Residual potential difference between LTLH and HTHH (−V) | HTHH memory evaluation | LTLH memory evaluation |
|---|---|---|---|---|---|---|
| Ex 5 | 145 | 130 | 62 | 83 | ○ | ○ |
| Ex 6 | 146 | 136 | 65 | 81 | ○ | ○ |
| Ex 7 | 154 | 117 | 66 | 88 | ○ | ○ |
| Ex 8 | 162 | 123 | 72 | 90 | ○ | ○ |
| Ex 9 | 163 | 129 | 70 | 93 | ○ | ○ |
| Ex 10 | 157 | 133 | 80 | 77 | ○ | ○ |
| Ex 11 | 156 | 142 | 81 | 75 | ○ | ○ |
| Ex 12 | 163 | 152 | 72 | 91 | ○ | ○ |
| Ex 13 | 151 | 141 | 56 | 95 | ○ | ○ |
| Ex 14 | 160 | 125 | 73 | 87 | ○ | ○ |
| Ex 15 | 168 | 127 | 80 | 88 | ○ | ○ |
| Ex 16 | 155 | 119 | 76 | 79 | ○ | ○ |
| Ex 17 | 171 | 123 | 84 | 87 | ○ | ○ |
| Ex 18 | 155 | 132 | 80 | 75 | ○ | ○ |
| Ex 19 | 143 | 119 | 54 | 89 | ○ | ○ |
| Ex 20 | 155 | 125 | 72 | 83 | ○ | ○ |
| Ex 21 | 156 | 118 | 72 | 84 | ○ | ○ |
| Ex 22 | 147 | 122 | 76 | 71 | ○ | ○ |
| Ex 23 | 153 | 131 | 62 | 91 | ○ | ○ |
| Ex 24 | 157 | 147 | 65 | 92 | ○ | ○ |
| Ex 25 | 168 | 134 | 86 | 82 | ○ | ○ |
| Ex 26 | 153 | 128 | 72 | 81 | ○ | ○ |

TABLE 13

| | Low temperature, low humidity*3 (−V) | Normal temperature, normal humidity*4 (−V) | High temperature, high humidity*5 (−V) | Residual potential difference between LTLH and HTHH (−V) | HTHH memory evaluation | LTLH memory evaluation |
|---|---|---|---|---|---|---|
| Ex 27 | 151 | 125 | 70 | 81 | ○ | ○ |
| Ex 28 | 164 | 135 | 80 | 84 | ○ | ○ |
| Ex 29 | 159 | 145 | 81 | 78 | ○ | ○ |
| Ex 30 | 186 | 162 | 121 | 65 | ○ | ○ |
| Ex 31 | 185 | 142 | 100 | 85 | ○ | ○ |
| Ex 32 | 162 | 125 | 76 | 86 | ○ | ○ |
| Ex 33 | 165 | 128 | 71 | 94 | ○ | ○ |
| Ex 34 | 175 | 118 | 96 | 79 | ○ | ○ |
| Ex 35 | 161 | 153 | 64 | 97 | ○ | ○ |
| Ex 36 | 155 | 118 | 80 | 75 | ○ | ○ |
| Ex 37 | 138 | 112 | 54 | 84 | ○ | ○ |
| Ex 38 | 149 | 113 | 72 | 77 | ○ | ○ |
| Ex 39 | 147 | 116 | 52 | 95 | ○ | ○ |
| Ex 40 | 139 | 122 | 56 | 83 | ○ | ○ |
| Ex 41 | 141 | 125 | 62 | 79 | ○ | ○ |
| Ex 42 | 142 | 132 | 65 | 77 | ○ | ○ |
| Ex 43 | 150 | 119 | 66 | 84 | ○ | ○ |
| Ex 44 | 159 | 126 | 72 | 87 | ○ | ○ |
| Ex 45 | 164 | 122 | 70 | 94 | ○ | ○ |
| Ex 46 | 152 | 131 | 80 | 72 | ○ | ○ |
| Ex 47 | 158 | 140 | 81 | 77 | ○ | ○ |
| Ex 48 | 161 | 148 | 72 | 89 | ○ | ○ |
| Ex 49 | 154 | 148 | 56 | 98 | ○ | ○ |
| Ex 50 | 162 | 129 | 73 | 89 | ○ | ○ |
| Ex 51 | 165 | 123 | 80 | 85 | ○ | ○ |

TABLE 14

| | Low temperature, low humidity*3 (−V) | Normal temperature, normal humidity*4 (−V) | High temperature, high humidity*5 (−V) | Residual potential difference between LTLH and HTHH (−V) | HTHH memory evaluation | LTLH memory evaluation |
|---|---|---|---|---|---|---|
| Ex 52 | 158 | 118 | 76 | 82 | ○ | ○ |
| Ex 53 | 169 | 122 | 84 | 85 | ○ | ○ |
| Ex 54 | 158 | 128 | 80 | 78 | ○ | ○ |
| Ex 55 | 146 | 122 | 54 | 92 | ○ | ○ |
| Ex 56 | 158 | 123 | 72 | 86 | ○ | ○ |
| Ex 57 | 157 | 121 | 72 | 85 | ○ | ○ |
| Ex 58 | 149 | 120 | 76 | 73 | ○ | ○ |
| Ex 59 | 156 | 126 | 62 | 94 | ○ | ○ |
| Ex 60 | 154 | 144 | 65 | 89 | ○ | ○ |
| Ex 61 | 166 | 132 | 86 | 80 | ○ | ○ |

TABLE 14-continued

| | Low temperature, low humidity*3 (−V) | Normal temperature, normal humidity*4 (−V) | High temperature, high humidity*5 (−V) | Residual potential difference between LTLH and HTHH (−V) | HTHH memory evaluation | LTLH memory evaluation |
|---|---|---|---|---|---|---|
| Ex 62 | 157 | 124 | 72 | 85 | ○ | ○ |
| Ex 63 | 152 | 122 | 70 | 82 | ○ | ○ |
| Ex 64 | 166 | 132 | 80 | 86 | ○ | ○ |
| Ex 65 | 158 | 149 | 81 | 77 | ○ | ○ |
| Ex 66 | 179 | 157 | 121 | 58 | ○ | ○ |
| Ex 67 | 183 | 140 | 100 | 83 | ○ | ○ |
| Ex 68 | 164 | 128 | 76 | 88 | ○ | ○ |
| Ex 69 | 168 | 122 | 71 | 97 | ○ | ○ |
| Ex 70 | 172 | 114 | 96 | 76 | ○ | ○ |
| Ex 71 | 165 | 151 | 64 | 101 | ○ | ○ |
| Ex 72 | 154 | 119 | 80 | 74 | ○ | ○ |
| Ex 73 | 167 | 135 | 80 | 87 | ○ | ○ |
| Ex 74 | 153 | 145 | 81 | 72 | ○ | ○ |
| Ex 75 | 185 | 162 | 121 | 64 | ○ | ○ |
| Ex 76 | 182 | 142 | 100 | 82 | ○ | ○ |

TABLE 15

| | Low temperature, low humidity*3 (−V) | Normal temperature, normal humidity*4 (−V) | High temperature, high humidity*5 (−V) | Residual potential difference between LTLH and HTHH (−V) | HTHH memory evaluation | LTLH memory evaluation |
|---|---|---|---|---|---|---|
| Ex 77 | 165 | 125 | 76 | 89 | ○ | ○ |
| Ex 78 | 162 | 128 | 71 | 91 | ○ | ○ |
| Ex 79 | 173 | 118 | 96 | 77 | ○ | ○ |
| Ex 80 | 146 | 130 | 62 | 84 | ○ | ○ |
| Ex 81 | 142 | 136 | 65 | 77 | ○ | ○ |
| Ex 82 | 151 | 117 | 66 | 85 | ○ | ○ |
| Ex 83 | 160 | 123 | 72 | 88 | ○ | ○ |
| Ex 84 | 161 | 129 | 70 | 91 | ○ | ○ |
| Ex 85 | 155 | 133 | 80 | 75 | ○ | ○ |
| Ex 86 | 152 | 142 | 81 | 71 | ○ | ○ |
| Ex 87 | 165 | 152 | 82 | 83 | ○ | ○ |
| Ex 88 | 156 | 141 | 76 | 80 | ○ | ○ |
| CE 1 | 168 | 122 | 58 | 110 | Δ (pos) | x (neg) |
| CE 2 | 178 | 129 | 53 | 125 | Δ (pos) | x (neg) |
| CE 3 | 229 | 121 | 92 | 137 | Δ (pos) | x (neg) |
| CE 4 | 271 | 222 | 130 | 141 | Δ (pos) | x (neg) |
| CE 5 | 308 | 292 | 177 | 131 | Δ (pos) | x (neg) |

*3Temperature 5° C., humidity 10%
*4Temperature 25° C., humidity 50%
*5Temperature 35° C., humidity 85%

The results in these tables show that the environmental dependency of potential and image is reduced and memory in low-temperature, low-humidity environments in particular is greatly improved by using the compound of the present invention.

Manufacturing examples: positively-charged monolayer photoreceptor

Example 89

A coating liquid prepared by dissolving and dispersing 5 mass parts of alcohol-soluble nylon (Amilan CM8000®, Tohray) with 5 mass parts of aminosilane-treated titanium oxide fine particles in 90 mass parts of methanol was dip coated on the outer circumference of an aluminum cylinder with an outer diameter of 24 mm as a conductive base, and dried for 30 minutes at 100° C. to form an under coat layer with a film thickness of about 2 μm.

7.0 mass parts of the styryl compound represented by Formula (II-12) above as a hole transport material, 3 mass parts of the compound represented by Formula (III-1) below as an electron transport material, 9.6 mass parts of polycarbonate resin (Panlite TS-2050®, Teijin Chemicals Ltd.) as a resin binder, 0.04 mass parts of silicone oil (KF-54®, Shinetsu Polymer) and 1.5 mass parts of the compound represented by Formula (I-1) above were dissolved in 100 mass parts of methylene chloride, 0.3 mass parts of the X-type metal-free phthalocyanine described in U.S. Pat. No. 3,357,989 were added as a charge generating material, and the mixture was dispersed in a sand grind mill to prepare a coating liquid. Using this coating liquid, a coated film was formed on the under coat layer, and dried for 60 minutes at 100° to form a monolayer photosensitive layer with a film thickness of about 25 μm and obtain a positively-charged monolayer electrophotographic photoreceptor.

(III-1)

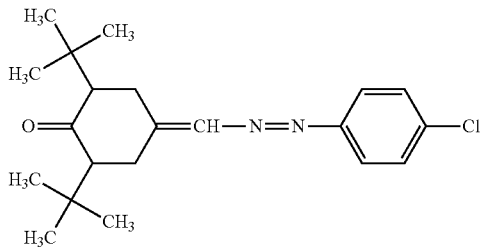

Examples 90 to 93

Electrophotographic photoreceptors were prepared as in Example 89 except that the compounds represented by Structural Formulae (I-2), (I-21), (I-29) and (I-37) above were substituted for the compound represented by Formula (I-1) above in Example 89.

Comparative Example 6

An electrophotographic photoreceptor was prepared as in Example 89 except that the compound represented by Formula (I-1) above was omitted.

Comparative Example 7

An electrophotographic photoreceptor was prepared as in Example 89 except that dioctyl phthalate (Wako Pure Chemical Industries) was substituted for the compound represented by Formula (I-1) in Example 89.

The photoreceptors prepared in Examples 89 to 93 and Comparative Examples 6 and 7 above were evaluated by the following methods. First, the photoreceptor surface was charged to +650 V by corona discharge in a dark place, and the surface potential $V_0$ immediately after charging was measured. Next, this photoreceptor was left for 5 seconds in a dark place, the surface potential V5 was measured, and the potential retention rate Vk5(%) 5 seconds after charging was determined according to the following Formula:

$$Vk_5=V_5/V_0\times 100.$$

Once the surface potential had reached +600 V, the photoreceptor was exposed for 5 seconds to 1.0 μW/cm$^2$ of exposure light dispersed to 780 nm with a filter using a halogen lamp as the light source, and the quantity of exposure required for the surface potential to decay to +300 V was given as E1/2(μJ/cm$^{-2}$), while the quantity of exposure required for it to decay to +50 V was given as sensitivity E50 (μJ/cm$^{-2}$).

The photoreceptors prepared in Examples 89 to 93 and Comparative Examples 6 and 7 above were also installed in an ozone exposure device in which the photoreceptor could be left in an ozone atmosphere, and exposed to ozone for 2 hours at 100 ppm, the potential retention rate was measured again, and the degree of change in the retention rate Vk5 after ozone exposure was determined and given as a percentage as the ozone exposure retention change rate (ΔVk5). The ozone exposure retention change rate was determined by the following formula given $Vk5_1$ as the retention rate before ozone exposure and the $Vk5_2$ as the retention rate after ozone exposure:

$$\Delta Vk5=Vk5_2\text{ (after ozone exposure)}/Vk5_1\text{, (before ozone exposure).}$$

The aforementioned measurement results are given in the following table as the electrical characteristics of the photoreceptors of Examples 89 to 93 and Comparative Examples 6 and 7.

TABLE 16

| | Charge generating material*6 | Additive (mass parts) | Charge transport material | Electron transport material | Vk5 (%) | E½ (μJcm$^{-2}$) | E50 (μJcm$^{-2}$) | Ozone exposure retention change rate (ΔVk5) (%) |
|---|---|---|---|---|---|---|---|---|
| Ex 89 | X-$H_2$Pc | I-1 (1.5) | II-12 | III-1 | 86.6 | 0.46 | 2.45 | 94.5 |
| Ex 90 | X-$H_2$Pc | I-2 (1.5) | II-12 | III-1 | 85.6 | 0.48 | 2.62 | 94.8 |
| Ex 91 | X-$H_2$Pc | I-21 (1.5) | II-12 | III-1 | 85.3 | 0.47 | 2.50 | 95.2 |
| Ex 92 | X-$H_2$Pc | I-29 (1.5) | II-12 | III-1 | 86.9 | 0.46 | 2.48 | 94.7 |
| Ex 93 | X-$H_2$Pc | I-37 (1.5) | II-12 | III-1 | 86.8 | 0.45 | 2.57 | 94.8 |
| CE 6 | X-$H_2$Pc | — | II-12 | III-1 | 84.6 | 0.5 | 2.56 | 76.7 |
| CE 7 | X-$H_2$Pc | Dioctyl phthalate (1.5) | II-12 | III-1 | 85.5 | 0.53 | 2.84 | 77.8 |

*6X-$H_2$Pc = X-type metal-free phthalocyanine

The results in this table show that the initial electrical characteristics were not greatly affected even when the compound of the present invention was used as an additive in each layer, while changes in the retention rate after ozone exposure were controlled.

Next, the photoreceptors prepared in Examples 89 to 93 and Comparative Examples 6 and 7 were mounted in a Brother HL-2040 printer that had been modified so that the surface potential of the photoreceptor could be measured, and the potential stability, image memory, and amount of film loss from the photosensitive layer due to friction with the paper and blade were evaluated before and after 10,000 sheets were printed on the printer. The results are shown in the table below.

For the image evaluation, image samples having a checker flag pattern in the first half and halftone in the second half were evaluated, and the presence or absence of image memory from the checker flag pattern in the half-tone part was noted. The results were given as O if no memory was observed, Δ if some memory was observed and × if the memory was obvious, and as "pos" if the dark and light areas appeared the same as in the original image, or "neg" if the dark and light areas were reversed from the original image.

TABLE 17

| | Initial bright part potential (V) | Initial image memory evaluation | Bright part potential after 10,000 sheets (V) | Change in bright part potential (V) | Image memory after repeated printing evaluation | Photosensitive layer film loss after printing (μm) |
|---|---|---|---|---|---|---|
| Ex 89 | 119 | ○ | 127 | 8 | ○ | 2.27 |
| Ex 90 | 124 | ○ | 135 | 11 | ○ | 2.28 |
| Ex 91 | 123 | ○ | 127 | 4 | ○ | 2.06 |
| Ex 92 | 117 | ○ | 129 | 12 | ○ | 2.12 |
| Ex 93 | 131 | ○ | 136 | 5 | ○ | 2.19 |
| CE 6 | 136 | ○ | 148 | 12 | ○ | 4.66 |
| CE 7 | 136 | ○ | 144 | 8 | ○ | 4.89 |

The results in the table above show no great difference in the initial actual electrical characteristics depending on whether or not the compound of the present invention was added to each layer, and the amount of film loss after repeated printing of 10,000 sheets was reduced by 50% or more. Moreover, no problems were observed in the potential and image evaluations after printing in this case.

Next, the potential characteristics of the photoreceptors were investigated in environments ranging from low temperature, low humidity to high temperature, high humidity on the aforementioned printer, and an image evaluation was performed at the same time. The results are shown in the table below.

TABLE 18

| | Low temperature, low humidity*3 (V) | Normal temperature, normal humidity*4 (V) | High temperature, high humidity*5 (V) | Residual potential difference between LTLH and HTHH (V) | HTHH memory evaluation | LTLH memory evaluation |
|---|---|---|---|---|---|---|
| Ex 89 | 159 | 130 | 78 | 81 | ○ | ○ |
| Ex 90 | 163 | 142 | 83 | 80 | ○ | ○ |
| Ex 91 | 179 | 161 | 106 | 73 | ○ | ○ |
| Ex 92 | 180 | 147 | 111 | 69 | ○ | ○ |
| Ex 93 | 168 | 137 | 88 | 80 | ○ | ○ |
| CE 6 | 171 | 132 | 60 | 111 | Δ (pos) | x (neg) |
| CE 7 | 180 | 136 | 55 | 125 | Δ (pos) | x (neg) |

The results of the table above show that the environmental dependency of potential and image is reduced, and memory in low-temperature, low-humidity environments in particular is greatly improved by using the compound of the present invention.

Manufacturing examples: positively charged stacked photoreceptor

Example 94

50 mass parts of the compound represented by Formula (II-15) above as a charge transport material, 50 mass parts of polycarbonate resin (Panlite TS-2050®, Teijin Chemicals Ltd.) as a resin binder, and 1.5 mass parts of the compound represented by Formula (I-1) above were dissolved in 800 mass parts of dichloromethane to prepare a coating liquid. This coating liquid was dip coated on the outer circumference of an aluminum cylinder with a diameter of 24 mm as a conductive base, and dried for 60 minutes at 120° C. to form a charge transport layer with a thickness of 15 μm.

1.5 mass parts of the X-type metal-free phthalocyanine described in U.S. Pat. No. 3,357,989 as a charge generating material, 10 mass parts of the stilbene compound represented by Formula (II-15) above as a hole transport material, 25 mass parts of the compound represented by Formula (III-1) above as an electron transport material and 60 mass parts of polycarbonate resin (Panlite TS-2050®, Teijin Chemicals Ltd.) as a resin binder were dissolved and dispersed in 800 mass parts of 1,2-dichloroethane to prepare a coating liquid which was dip coated on the charge transport layer, and dried for 60 minutes at 100° C. to form a photosensitive layer with a film thickness of 15 μm and prepare a positively charged stacked photoreceptor.

Example 95

50 mass parts of the compound represented by Formula (II-15) above as a charge transport material and 50 mass parts of polycarbonate resin (Panlite TS-2050®, Teijin Chemicals Ltd.) as a resin binder were dissolved in 800 mass parts of dichloromethane to prepare a coating liquid. This coating liquid was dip coated on the outer circumference of an aluminum cylinder with an outer diameter of 24 mm as a conductive base, and dried for 60 minutes at 120° C. to form a charge transport layer with a film thickness of 15 μm.

1.5 mass parts of the X-type metal-free phthalocyanine described in U.S. Pat. No. 3,357,989 as a charge generating material, 10 mass parts of the stilbene compound represented by Formula (II-15) above as a hole transport material, 25 mass parts of the compound represented by Formula (III-1) above as an electron transport material, 60 mass parts of polycarbonate resin (Panlite TS-2050®, Teijin Chemicals Ltd.) as a resin binder and 1.5 mass parts of the compound represented by Formula (I-1) above were dissolved and dispersed in 800 mass parts of 1,2-dichloroethane to prepare a coating liquid which was dip coated on the charge transport layer, and dried for 60 minutes at 100° C. to form a photosensitive layer with a film thickness of 15 μm and prepare a positively charged stacked photoreceptor.

Example 96

50 mass parts of the compound represented by Formula (II-15) above as a charge transport material, 50 mass parts of polycarbonate resin (Panlite TS-2050®, Teijin Chemicals Ltd.) as a resin binder and 1.5 mass parts of the compound represented by Formula (I-1) above were dissolved in 800 mass parts of dichloromethane to prepare a coating liquid. This coating liquid was dip coated on the outer circumference of an aluminum cylinder with an outer diameter of 24 mm as a conductive base, and dried for 60 minutes at 120° C. to form a charge transport layer with a film thickness of 15 μm.

1.5 mass parts of the X-type metal-free phthalocyanine described in U.S. Pat. No. 3,357,989 as a charge generating material, 10 mass parts of the stilbene compound represented by Formula (II-15) above as a hole transport material, 25 mass parts of the compound represented by Formula (III-1) above as an electron transport material, 60 mass parts of polycarbonate resin (Panlite TS-2050®, Teijin Chemicals Ltd.) as a resin binder and 1.5 mass parts of the compound represented by Formula (I-1) above were dissolved and dispersed in 800 mass parts of 1,2-dichloroethane to prepare a coating liquid which was then dip coated on the charge transport layer, and dried for 60 minutes at 100° C. to form a photosensitive layer with a film thickness of 15 μm and prepare a positively charged stacked photoreceptor.

Comparative Example 8

An electrophotographic photoreceptor was prepared as in Example 94 except that the compound represented by Formula (I-1) above was not used.

Comparative Example 9

An electrophotographic photoreceptor was prepared as in Example 96 except that the compound represented by Formula (I-1) in Example 96 was replaced with dioctyl phthalate (Wako Pure Chemical Industries).

The photoreceptor prepared in Examples 94 to 96 and Comparative Examples 8 and 9 above were evaluated by the same methods used for Example 89 and the like.

As the measurement results, the electrical characteristics of Examples 94 to 96 and Comparative Examples 8 and 9 are shown in the following table.

TABLE 19

| | Charge generating material*7 | Additives (mass parts): Charge transport layer | Additives (mass parts): Photosensitive layer | Charge transport material | Electron transport material | Vk5 (%) | E½ (μJcm$^{-2}$) | E50 (μJcm$^{-2}$) | Ozone exposure retention change rate ΔVk5 (%) |
|---|---|---|---|---|---|---|---|---|---|
| Ex 94 | X-$H_2$Pc | I-1 (1.5) | — | II-15 | III-1 | 87.8 | 0.35 | 2.22 | 96.7 |
| Ex 95 | X-$H_2$Pc | — | I-1 (1.5) | II-15 | III-1 | 88.6 | 0.37 | 2.30 | 95.8 |
| Ex 96 | X-$H_2$Pc | I-1 (1.5) | I-1 (1.5) | II-15 | III-1 | 86.6 | 0.38 | 2.33 | 96.4 |
| CE 8 | X-$H_2$Pc | — | — | II-15 | III-1 | 85.4 | 0.52 | 2.50 | 78.9 |
| CE 9 | X-$H_2$Pc | Dioctyl phthalate (1.5) | Dioctyl phthalate (1.5) | II-15 | III-1 | 87.6 | 0.55 | 2.79 | 79.2 |

*7X-$H_2$Pc = X-type metal-free phthalocyanine

The results in the table above show that the initial electrical characteristics were not greatly affected even by using the compound of the present invention in each layer as an additive, and changes in the retention rate after ozone exposure were controlled.

Next, the photoreceptors prepared in Examples 94 to 96 and Comparative Examples 8 and 9 were loaded in a Brother HL-2040 printer that had been modified so that the surface potential of the photoreceptor could be measured, and the potential stability, image memory, and amount of film loss from the photosensitive layer due to friction with the paper and blade were evaluated before and after 10,000 sheets were printed on the printer. The results are shown in the table below.

The image evaluation was performed by the same methods used in Example 89 and the like.

TABLE 20

| | Initial bright part potential (V) | Initial image memory evaluation | Bright part potential after 10,000 sheets (V) | Change in bright part potential (V) | Image memory after repeated printing evaluation | Photosensitive layer film loss after printing (μm) |
|---|---|---|---|---|---|---|
| Ex 94 | 114 | ○ | 122 | 8 | ○ | 2.12 |
| Ex 95 | 121 | ○ | 132 | 11 | ○ | 2.2 |
| Ex 96 | 117 | ○ | 121 | 4 | ○ | 2.15 |
| CE 8 | 141 | ○ | 149 | 8 | ○ | 4.45 |
| CE 9 | 134 | ○ | 146 | 12 | ○ | 4.78 |

The results in the table above show no great difference in the initial actual electrical characteristics depending on whether or not the compound of the present invention was added to each layer, while film loss after repeated printing of 10,000 sheets was reduced by 50% or more. There were also no problems in the potential or image evaluation after printing in this case.

Next, the potential characteristics of the photoreceptors were investigated in environments ranging from low temperature, low humidity to high temperature, high humidity on the aforementioned digital copier, and an image evaluation was performed at the same time. The results are shown in the table below.

TABLE 21

| | Low temperature, low humidity*3 (V) | Normal temperature, normal humidity*4 (V) | High temperature, high humidity*5 (V) | Residual potential difference between LTLH and HTHH (V) | HTHH memory evaluation | LTLH memory evaluation |
|---|---|---|---|---|---|---|
| Ex 94 | 156 | 124 | 81 | 75 | ○ | ○ |
| Ex 95 | 161 | 138 | 79 | 82 | ○ | ○ |
| Ex 96 | 175 | 163 | 98 | 77 | ○ | ○ |
| CE 8 | 175 | 133 | 63 | 112 | Δ (pos) | x (neg) |
| CE 9 | 177 | 140 | 58 | 119 | Δ (pos) | x (neg) |

The results of the table above show that the environmental dependency of potential and image is reduced, and memory in low-temperature, low-humidity environments in particular is greatly improved by using the compound of the present invention.

As confirmed above, the electrophotographic photoreceptor of the present invention provides satisfactory effects in various charging processes and development processes, regardless of whether the photoreceptor is negatively charged or positively charged. It has been shown that an electrophotographic photoreceptor that has stable electrical characteristics both initially and after repeated use and under different environmental conditions, and that does not cause image memory and other image problems under these conditions, can be achieved by using a specific compound as an additive in the electrophotographic photoreceptor of the present invention.

The invention claimed is:

1. An electrophotographic photoreceptor, comprising:

a conductive base; and a photosensitive layer provided on the conductive base and containing a diadamantyl diester compound represented by General Formula (I) below:

(I)

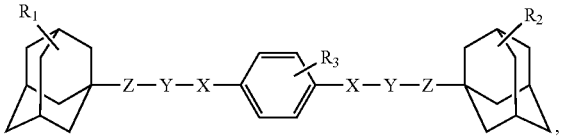

where, $R_1$, $R_2$ and $R_3$ each independently represent a hydrogen atom, halogen atom, optionally substituted $C_{1-6}$ alkyl group, optionally substituted $C_{1-6}$ alkoxyl group, $C_{6-20}$ aryl group or heterocyclic group, X and Z represent single bonds or optionally substituted $C_{1-6}$ alkylene groups, and Y represents an OCO group or COO group.

2. An electrophotographic photoreceptor, comprising:

a conductive base; and an under coat layer provided on the conductive base and containing a diadamantyl diester compound represented by General Formula (I) below:

(I)

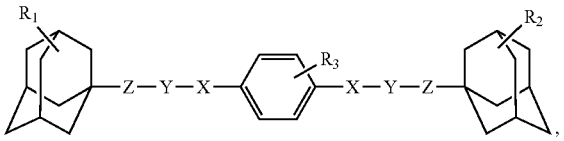

where, $R_1$, $R_2$ and $R_3$ each independently represent a hydrogen atom, halogen atom, optionally substituted $C_{1-6}$ alkyl group, optionally substituted $C_{1-6}$ alkoxyl group, $C_{6-20}$ aryl group or heterocyclic group, X and Z represent single bonds or optionally substituted $C_{1-6}$ alkylene groups, and Y represents an OCO group or COO group.

3. An electrophotographic photoreceptor, comprising:

a conductive base; and a charge generating layer provided on the conductive base and containing a diadamantyl diester compound represented by General Formula (I) below:

(I)

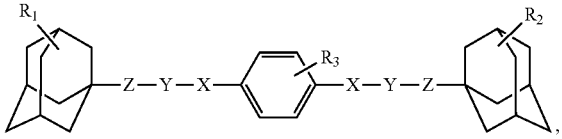

where, $R_1$, $R_2$ and $R_3$ each independently represent a hydrogen atom, halogen atom, optionally substituted $C_{1-6}$ alkyl group, optionally substituted $C_{1-6}$ alkoxyl group, $C_{6-20}$ aryl group or heterocyclic group, X and Z represent single bonds or optionally substituted $C_{1-6}$ alkylene groups, and Y represents an OCO group or COO group.

4. An electrophotographic photoreceptor, comprising:

a conductive base; and a charge transport layer provided on the conductive base and containing a diadamantyl diester compound represented by General Formula (I) below:

(I)

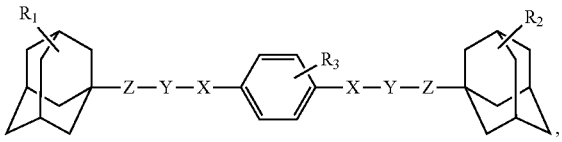

where, $R_1$, $R_2$ and $R_3$ each independently represent a hydrogen atom, halogen atom, optionally substituted $C_{1-6}$ alkyl group, optionally substituted $C_{1-6}$ alkoxyl group, $C_{6-20}$ aryl group or heterocyclic group, X and Z represent single bonds or optionally substituted $C_{1-6}$ alkylene groups, and Y represents an OCO group or COO group.

5. An electrophotographic photoreceptor, comprising:

a condustive base; and a surface protective layer provided on the conductive base and containing a diadamantyl diester compound represented by General Formula (I) below:

(I)

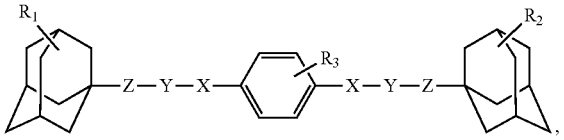

where, $R_1$, $R_2$ and $R_3$ each independently represent a hydrogen atom, halogen atom, optionally substituted $C_{1-6}$ alkyl group, optionally substituted $C_{1-6}$ alkoxyl group, $C_{6-20}$ aryl group or heterocyclic group, X and Z represent single bonds or optionally substituted $C_{1-6}$ alkylene groups, and Y represents an OCO group or COO group.

6. The electrophotographic photoreceptor according to claim 1, wherein the photoreceptive layer is a positively-charged monolayer-type layer.

7. The electrophotographic photoreceptor according to claim 1, wherein the photoreceptive layer is a positively-charged stacked-type layer.

8. The electrophotographic photoreceptor according to claim 1, wherein the diadamantyl diester compound has a structure represented by Formula (I-1) below:

(I-1)

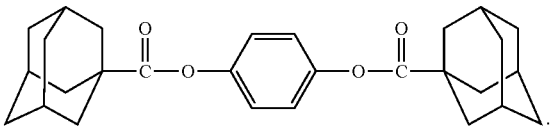

9. The electrophotographic photoreceptor according to claim 1, further comprising a resin binder contained in the layer containing the diadamantyl diester compound, and wherein said layer contains up to 30 mass parts of the diadamantyl diester compound per 100 mass parts of the resin binder.

10. A method for manufacturing an electrophotographic photoreceptor, comprising the steps of:

providing a coating liquid containing a diadamantyl diester compound represented by General Formula (I) below:

(I)

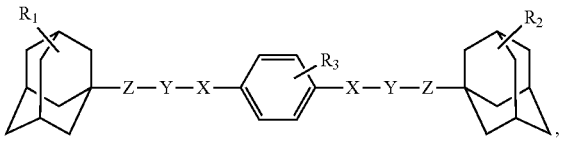

where, $R_1$, $R_2$ and $R_3$ each independently represent a hydrogen atom, halogen atom, optionally substituted $C_{1-6}$ alkyl group, optionally substituted $C_{1-6}$ alkoxyl group, $C_{6-20}$ aryl group or heterocyclic group, X and Z represent single bonds or optionally substituted $C_{1-6}$ alkylene groups, and Y represents an OCO group or COO group, and applying the coating liquid to a conductive base to form a layer.

11. The electrophotographic photoreceptor according to claim 2, wherein the diadamantyl diester compound has a structure represented by Formula (I-1) below:

(I-1)

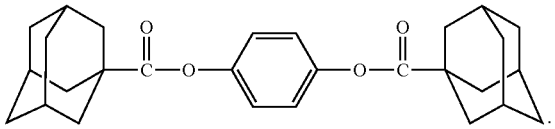

12. The electrophotographic photoreceptor according to claim 2, further comprising a resin binder contained in the layer containing the diadamantyl diester compound, and wherein said layer contains up to 30 mass parts of the diadamantyl diester compound per 100 mass parts of the resin binder.

13. The electrophotographic photoreceptor according to claim 3, wherein the diadamantyl diester compound has a structure represented by Formula (I-1) below:

(I-1)

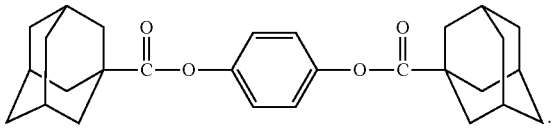

14. The electrophotographic photoreceptor according to claim 3, further comprising a resin binder contained in the layer containing the diadamantyl diester compound, and wherein said layer contains up to 30 mass parts of the diadamantyl diester compound per 100 mass parts of the resin binder.

15. The electrophotographic photoreceptor according to claim 4, wherein the diadamantyl diester compound has a structure represented by Formula (I-1) below:

(I-1)

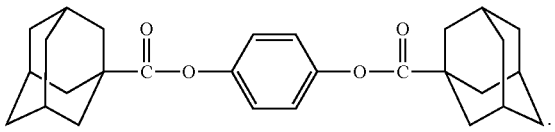

16. The electrophotographic photoreceptor according to claim 4, further comprising a resin binder contained in the layer containing the diadamantyl diester compound, and wherein said layer contains up to 30 mass parts of the diadamantyl diester compound per 100 mass parts of the resin binder.

17. The electrophotographic photoreceptor according to claim 5, wherein the diadamantyl diester compound has a structure represented by Formula (I-1) below:

(I-1)

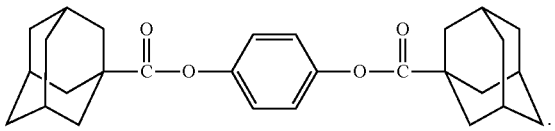

18. The electrophotographic photoreceptor according to claim 5, further comprising a resin binder contained in the layer containing the diadamantyl diester compound, and wherein said layer contains up to 30 mass parts of the diadamantyl diester compound per 100 mass parts of the resin binder.

* * * * *